US012257475B2

(12) United States Patent
Bayerlein et al.

(10) Patent No.: US 12,257,475 B2
(45) Date of Patent: Mar. 25, 2025

(54) SYSTEMS AND METHODS FOR RESTRICTING TRANSVERSE MOVEMENT OF A TREADMILL BELT

(71) Applicant: Woodway USA, Inc., Waukesha, WI (US)

(72) Inventors: Douglas G. Bayerlein, Waukesha, WI (US); Jose D. Bernal-Ramirez, Waukesha, WI (US); Emmanuel Guerrero, Waukesha, WI (US); Timothy M. Knezic, Waukesha, WI (US)

(73) Assignee: Woodway USA, Inc., Waukesha, WI (US)

( * ) Notice: Subject to any disclaimer, the term of this patent is extended or adjusted under 35 U.S.C. 154(b) by 0 days.

(21) Appl. No.: 18/414,257

(22) Filed: Jan. 16, 2024

(65) Prior Publication Data

US 2024/0149106 A1 May 9, 2024

Related U.S. Application Data

(63) Continuation of application No. 17/701,992, filed on Mar. 23, 2022, now Pat. No. 11,925,832, which is a (Continued)

(51) Int. Cl.
*A63B 22/02* (2006.01)

(52) U.S. Cl.
CPC ..... *A63B 22/0207* (2015.10); *A63B 22/0235* (2013.01); *A63B 22/0285* (2013.01)

(58) Field of Classification Search
CPC ..... A63B 22/0207; A63B 22/0235; A63B 22/0285; A63B 22/02; A63B 22/0214; (Continued)

(56) References Cited

U.S. PATENT DOCUMENTS 4,334,676 A 6/1982 Schonenberger
4,342,452 A * 8/1982 Summa ..... A63B 21/00069 482/54

(Continued)

FOREIGN PATENT DOCUMENTS

CN 205699101 11/2016
CN 20783812 9/2018

(Continued)

OTHER PUBLICATIONS

Extended European Search Report on EP application No. 20868740.0 dated Sep. 14, 2023.

(Continued)

*Primary Examiner* — Garrett K Atkinson
(74) *Attorney, Agent, or Firm* — Foley & Lardner LLP

(57) ABSTRACT

A treadmill includes a frame having a front end and a rear end, substantially opposite the front end; a front shaft assembly coupled to the frame proximate the front end of the frame; a rear shaft assembly coupled to the frame proximate the rear end of the frame; a running belt disposed about the front and rear shaft assemblies; and a bumper coupled to the frame proximate the running belt such that the bumper is disposed between the running belt and the frame. The bumper includes a partially rounded surface and a substantially flat surface. In use, the partially rounded surface and the substantially flat surface of the bumper are configured to selectively engage and restrict movement of the running belt towards at least a portion of the frame.

20 Claims, 17 Drawing Sheets

Related U.S. Application Data continuation of application No. PCT/US2020/052191, filed on Sep. 23, 2020.

(60) Provisional application No. 62/905,060, filed on Sep. 24, 2019.

(58) Field of Classification Search
CPC ..... A63B 71/0036; A63B 71/0622; A63B 2022/206; A63B 2071/065; A63B 2071/0675; A63B 2209/00; A63B 2209/10; A63B 2225/682; A63B 2225/685
See application file for complete search history.

(56) References Cited

U.S. PATENT DOCUMENTS

| | | | | | |
|---|---|---|---|---|---|
| 4,344,616 | A * | 8/1982 | Ogden | A63B 22/0023 | 482/54 |
| 4,602,779 | A * | 7/1986 | Ogden | A63B 22/0023 | 482/54 |
| 4,886,266 | A * | 12/1989 | Trulaske | A63B 22/0023 | 198/840 |
| 5,203,800 | A * | 4/1993 | Meredith | A63B 22/02 | 482/54 |
| 5,302,162 | A * | 4/1994 | Pasero | A63B 22/02 | 198/814 |
| 5,368,532 | A * | 11/1994 | Farnet | A63B 22/02 | 482/54 |
| 5,538,489 | A | 7/1996 | Magid | | |
| 6,652,424 | B2 | 11/2003 | Dalebout | | |
| 6,682,461 | B2 * | 1/2004 | Wang | A63B 22/02 | 482/54 |
| 6,764,430 | B1 * | 7/2004 | Fencel | B65G 39/02 | 482/54 |
| 7,594,878 | B1 * | 9/2009 | Joannou | A61H 1/005 | 482/54 |
| 10,449,411 | B2 * | 10/2019 | Cei | A63B 22/02 | |
| 10,632,339 | B2 * | 4/2020 | Chen | A63B 21/0125 | |
| 2001/0016543 | A1 * | 8/2001 | Dalebout | A63B 22/02 | 482/57 |
| 2005/0039541 | A1 * | 2/2005 | Kurono | A61B 5/1038 | 73/800 |
| 2005/0233864 | A1 * | 10/2005 | Smith | A63B 22/02 | 482/52 |
| 2007/0281832 | A1 * | 12/2007 | Alessandri | A63B 22/02 | 112/475.08 |
| 2010/0049105 | A1 * | 2/2010 | Joannou | A63B 22/0235 | 601/49 |
| 2012/0178591 | A1 | 7/2012 | Remelius | | |
| 2012/0231934 | A1 * | 9/2012 | Lo | A63B 22/02 | 482/54 |
| 2013/0190139 | A1 * | 7/2013 | Piaget | A63B 22/0214 | 482/52 |
| 2016/0166877 | A1 * | 6/2016 | Cei | A63B 22/0285 | 482/54 |
| 2016/0213976 | A1 * | 7/2016 | So | A63B 71/0622 | |
| 2017/0087417 | A1 * | 3/2017 | Peavy | A63B 71/0622 | |
| 2017/0136289 | A1 * | 5/2017 | Frank | A63B 24/0087 | |
| 2018/0056119 | A1 * | 3/2018 | Zhu | A63B 71/0622 | |
| 2018/0140903 | A1 * | 5/2018 | Poure | A63B 23/1227 | |
| 2018/0361194 | A1 * | 12/2018 | Corbalis | A63B 22/0214 | |
| 2019/0192952 | A1 * | 6/2019 | Powell | A63B 71/0686 | |
| 2019/0314674 | A1 * | 10/2019 | Chen | A63B 22/20 | |
| 2020/0129837 | A1 * | 4/2020 | Liao | A63B 24/0087 | |
| 2020/0398103 | A1 * | 12/2020 | Moore | A63B 69/0064 | |

FOREIGN PATENT DOCUMENTS

| | | |
|---|---|---|
| CN | 108785982 | 11/2018 |
| EP | 0 334 608 A2 | 9/1989 |

OTHER PUBLICATIONS

International Search Report and Written Opinion for International Application No. PCT/US2020/052191, mailed Jan. 7, 2021, 10 pages.

* cited by examiner

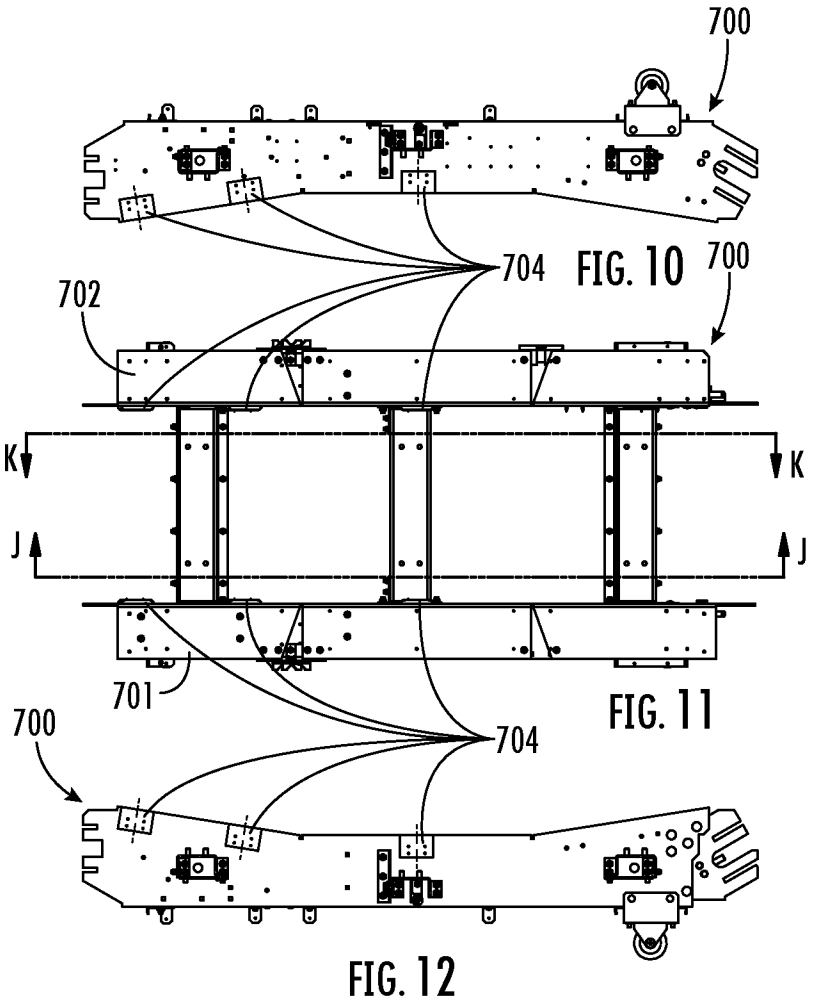
FIG. 10
FIG. 11
FIG. 12
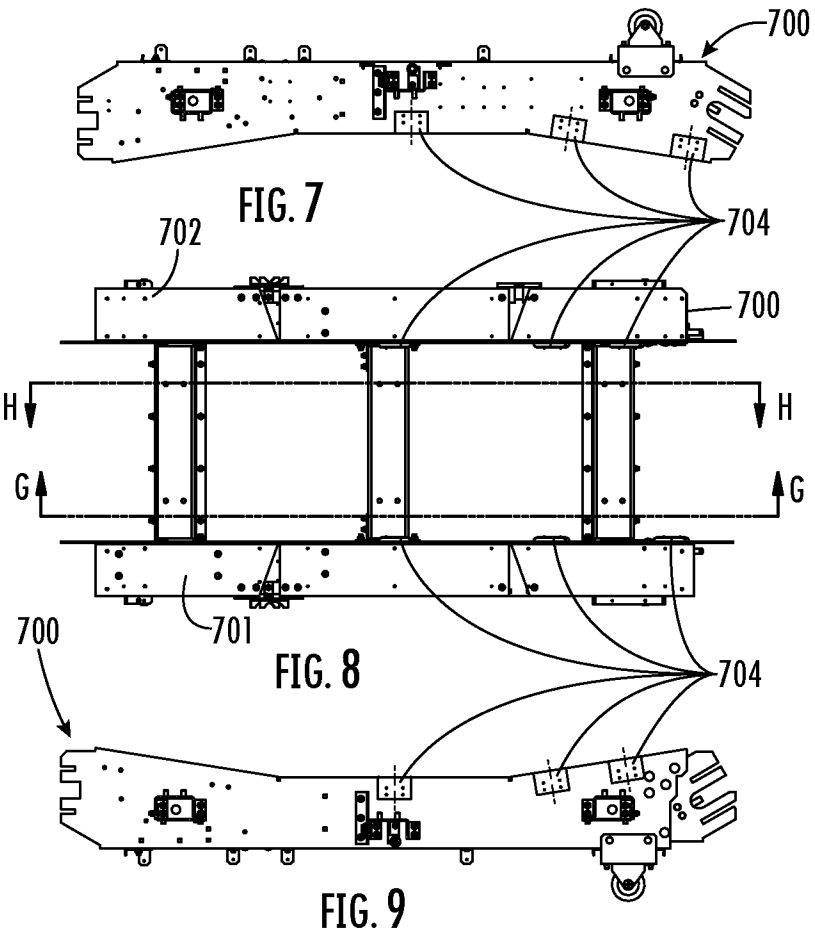
FIG. 7
FIG. 8
FIG. 9

SYSTEMS AND METHODS FOR RESTRICTING TRANSVERSE MOVEMENT OF A TREADMILL BELT

CROSS-REFERENCE TO RELATED PATENT APPLICATIONS

This application is a continuation of U.S. patent application Ser. No. 17/701,992, filed Mar. 23, 2022, which is a continuation of PCT/US2020/052191, filed Sep. 23, 2020, which claims the benefit of and priority to U.S. Provisional Application No. 62/905,060, filed Sep. 24, 2019, each of which are incorporated herein by reference in their entireties.

TECHNICAL FIELD

The present disclosure relates generally to exercises devices. More specifically, the present disclosure relates to exercise devices with moving belts.

BACKGROUND

Treadmills include running belts that rotate relative a frame so as to provide a continuous surface on which a user may walk or run (or perform variations walking/running) Extended use or specific use patterns can cause the running belt of the treadmill to move in a longitudinally transverse direction. Transverse movement of the running belt can lead to uneven wear or damage as a result of the running belt contacting unintended components of the treadmill. Accordingly, it is desirable to retain the belt of the treadmill in the desired position during use.

SUMMARY

One embodiment of the present disclosure is a treadmill. The treadmill includes a frame having a front end and a rear end, substantially opposite the front end; a front shaft assembly coupled to the frame proximate the front end of the frame; a rear shaft assembly coupled to the frame proximate the rear end of the frame; a running belt disposed about the front and rear shaft assemblies; and, a bumper coupled to the frame proximate the running belt such that the bumper is disposed between the running belt and the frame. In use, the bumper is configured to at least one of selectively move the running belt away from the frame and restrict movement of the running belt towards at least a portion of the frame.

The running belt may define a running surface and the bumper is disposed at least partially below the running surface.

In some embodiments, the bumper includes a first bumper and a second bumper. The first bumper is disposed between the frame and the running belt and the second bumper is disposed between the frame and the running belt such that the first and second bumpers are disposed on transverse sides of the running belt.

In some embodiments, the bumper is at least partially made of at least one of Nylon or ultra-high molecular weight Polyethylene.

In some embodiments, the bumper is configured to selectively deflect inwardly away from the running belt upon an impact of the running belt with the bumper.

In some embodiments, the bumper is rigid and non-deflecting such that the running belt slides or rubs against the bumper with substantially no inward deflection of the bumper.

In some embodiments, the bumper defines an aperture that receives a fastener to couple the bumper to the frame.

In some embodiments, the bumper includes a partially rounded surface and a substantially flat surface coupled to the partially rounded surface, wherein the substantially flat surface of the bumper is directly coupled to the frame.

In some embodiments, the partially rounded surface and the substantially flat surface of the bumper are made of at least partially different materials.

Another embodiment of the present disclosure is a treadmill. The treadmill includes a frame having a front end and a rear end substantially opposite the front end; a front shaft assembly coupled to the frame proximate the front end of the frame; a rear shaft assembly coupled to the frame proximate the rear end of the frame; a running belt disposed about the front and rear shaft assemblies; and, a first left side bumper coupled to the frame proximate the running belt such that the first left side bumper is disposed between the frame and the running belt. In use, the first left side bumper is configured to selectively restrict movement of the running belt toward the frame. The treadmill also includes a first right side bumper coupled to the frame proximate the running belt such that the first right side bumper is disposed between the frame and the running belt. In use, the first right side bumper is configured to selectively restrict movement of the running belt toward the frame.

In some embodiments, the first left side bumper is positioned on or substantially on a transverse opposite side of the running belt relative to the first right side bumper.

In some embodiments, the treadmill further includes a second left side bumper coupled to the frame and spaced apart from the first left side bumper. In use, the second left side bumper is configured to selectively restrict movement of the running belt toward the frame. The treadmill may further include a second right side bumper coupled to the frame and spaced apart from the first right side bumper. In use, the second right side bumper is configured to selectively restrict movement of the running belt toward the frame.

In some embodiments, each of the first and second left side bumpers and the first and second right side bumpers are substantially identical in shape to each other. In some embodiments, at least one of the first and second left side bumpers and the first and second right side bumpers differs in shape relative to the remaining of the at least one of the first and second left side bumpers and the first and second right side bumpers.

In some embodiments, the running belt defines a running surface at least a portion of which is curved.

In some embodiments, at least a portion of one of the first left and right side bumpers is positioned at or below the running surface.

Another embodiment of the present disclosure is a method of restricting transverse movement of a running belt of a treadmill. The method includes providing a frame including a left side member and a right side member, the left side member spaced apart from the right side member; providing a running belt coupled to the frame; disposing a first bumper between the right side member of the frame and the running belt; disposing a second bumper between the left side member of the frame and the running belt; and selectively restricting, by one of the first bumper or the second bumper, the lateral movement of the running belt relative to the frame.

In some embodiments, the running belt defines a running surface, at least a portion of which is curved.

In some embodiments, wherein during the selective restriction, the running belt slides along or rubs against the one of the first bumper or the second bumper.

In some embodiments, the method further includes in response to coming into contact with the running belt, deflecting, by the one of the first bumper or the second bumper inwardly away from the running belt.

This summary is illustrative only and is not intended to be in any way limiting. Other aspects, inventive features, and advantages of the devices or processes described herein will become apparent in the detailed description set forth herein, taken in conjunction with the accompanying figures, wherein like reference numerals refer to like elements.

BRIEF DESCRIPTION OF THE FIGURES

FIG. 7 is a side view of a treadmill frame, according to an exemplary embodiment.

FIG. 8 is a top view of the treadmill frame of FIG. 7, according to an exemplary embodiment.

FIG. 9 is an additional side view of the treadmill frame of FIG. 7, according to an exemplary embodiment.

FIG. 10 is a side view of a treadmill frame, according to an exemplary embodiment.

FIG. 11 is a top view of the treadmill frame of FIG. 10, according to an exemplary embodiment.

FIG. 12 is an additional side view of the treadmill frame of FIG. 10, according to an exemplary embodiment.

DETAILED DESCRIPTION

Figure 1:
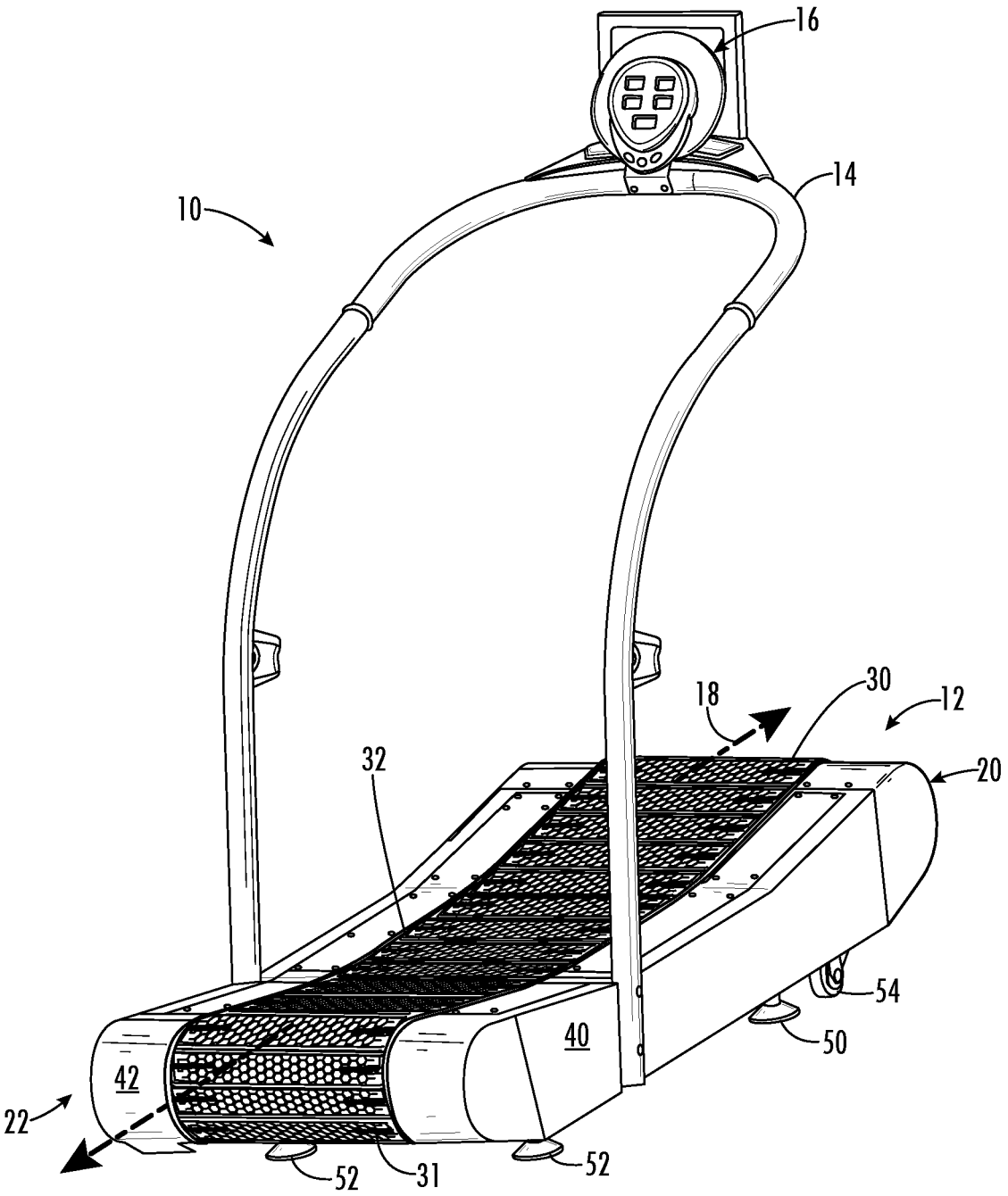
FIG. 1 is a perspective view of a treadmill having a non-planar running surface, according to an exemplary embodiment.

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring to the Figures generally, a treadmill with bumpers is shown according to various embodiments herein. A treadmill includes a running belt that rotationally moves relative to a substantially stationary treadmill frame. The bumpers are coupled to the treadmill frame to constrain a transverse movement of the running belt relative to a longitudinal axis of the running belt. In particular, bumpers are coupled to at least one of the opposing sides of the treadmill frame, preferably both sides such that the bumpers are disposed on transverse opposite sides of and adjacent to the running belt. The bumpers are configured to keep or maintain the running belt in a desired position (i.e., substantially in a side-to-side middle of the treadmill) during operation of treadmill. In this regard and as the treadmill is operated, a user may provide uneven forces to the running belt that cause the running belt to move laterally or side-to-side relative to the treadmill frame in addition to the rotation in the desired longitudinal direction. The side-to-side movement may cause the running belt to move transversely relative to the frame and the longitudinal axis. This movement may result in the running belt contacting various parts of the treadmill (e.g., parts of the frame) in an undesirable manner which may lead to non-smooth rotational movement of the running belt (e.g., off-balanced rotation) as well as uneven wear of the running belt. The bumpers are positioned to bump, impact, or otherwise contact the running belt during any side-to-side movement to nudge the running belt away from the sides of the treadmill frame and back towards the desired central or substantially central position. Accordingly, the bumpers provide several benefits: the mitigation of undesireable wear on the running belt resulting from the extended rubbing of the rotating sides of the running belt against stationary elements of the treadmill frame; the mitigation of the potential misalignment or dislodging of the running belt resulting from too much lateral movement of the belt relative to the support structure for the running belt (e.g., a plurality of bearings); a potential in operating cost savings resulting from the reduction in repairs needed for the running belt (e.g., for a slat style running belt, the slats of the belt may maintain their form longer by not impacting the treadmill frame); quieter operation of the treadmill because the rotating treadmill belt is prevented from contacting stationary elements of the treadmill frame and, among other benefits, to promote a continuous smooth movement of the running belt relative to the treadmill frame due to maintenance of the running belt on the desired running belt support structure(s).

Figure 2:
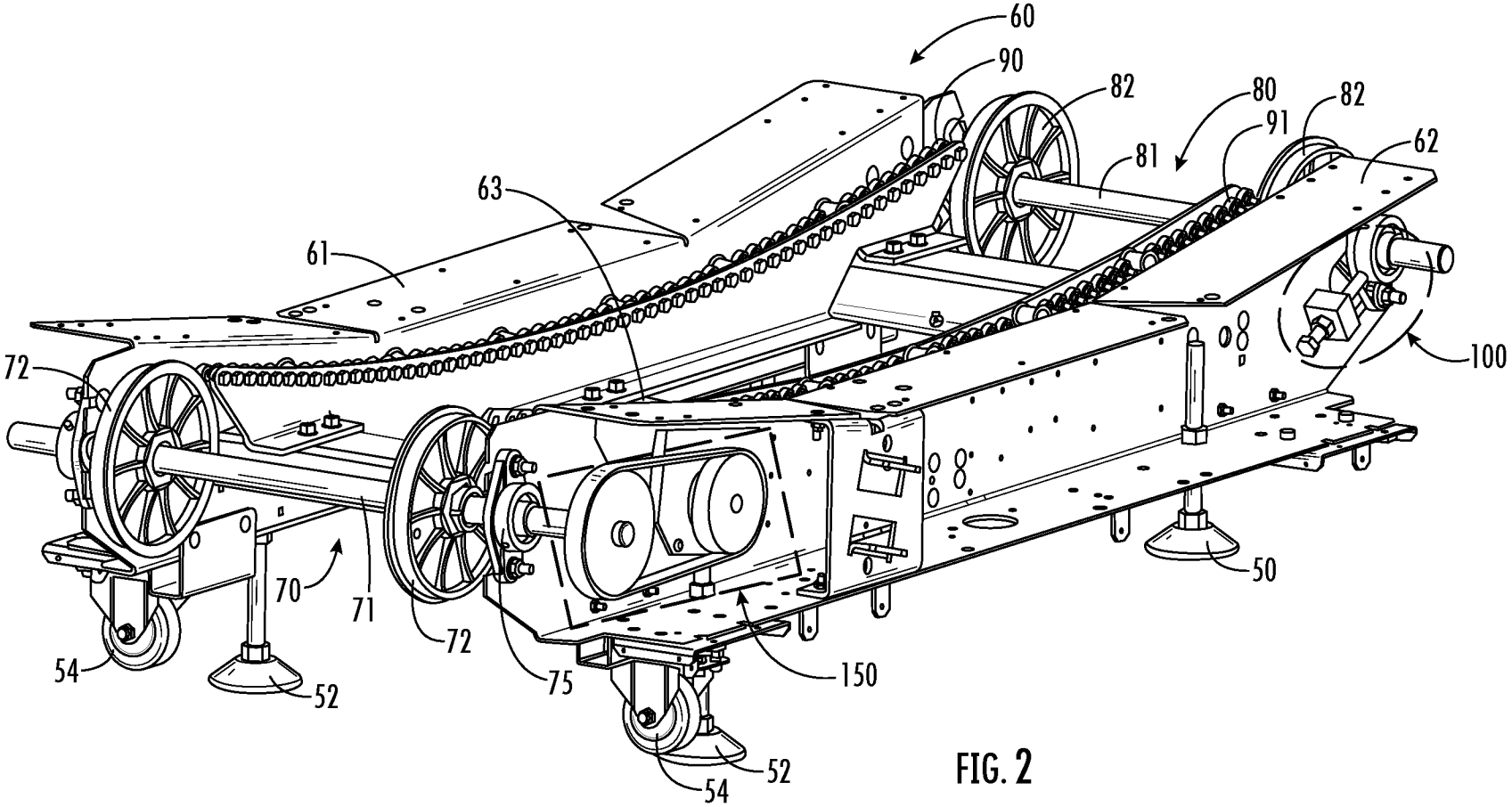
FIG. 2 is a perspective view of the treadmill of FIG. 1 with most of the external, protective covers removed, according to an exemplary embodiment.
Figure 3:
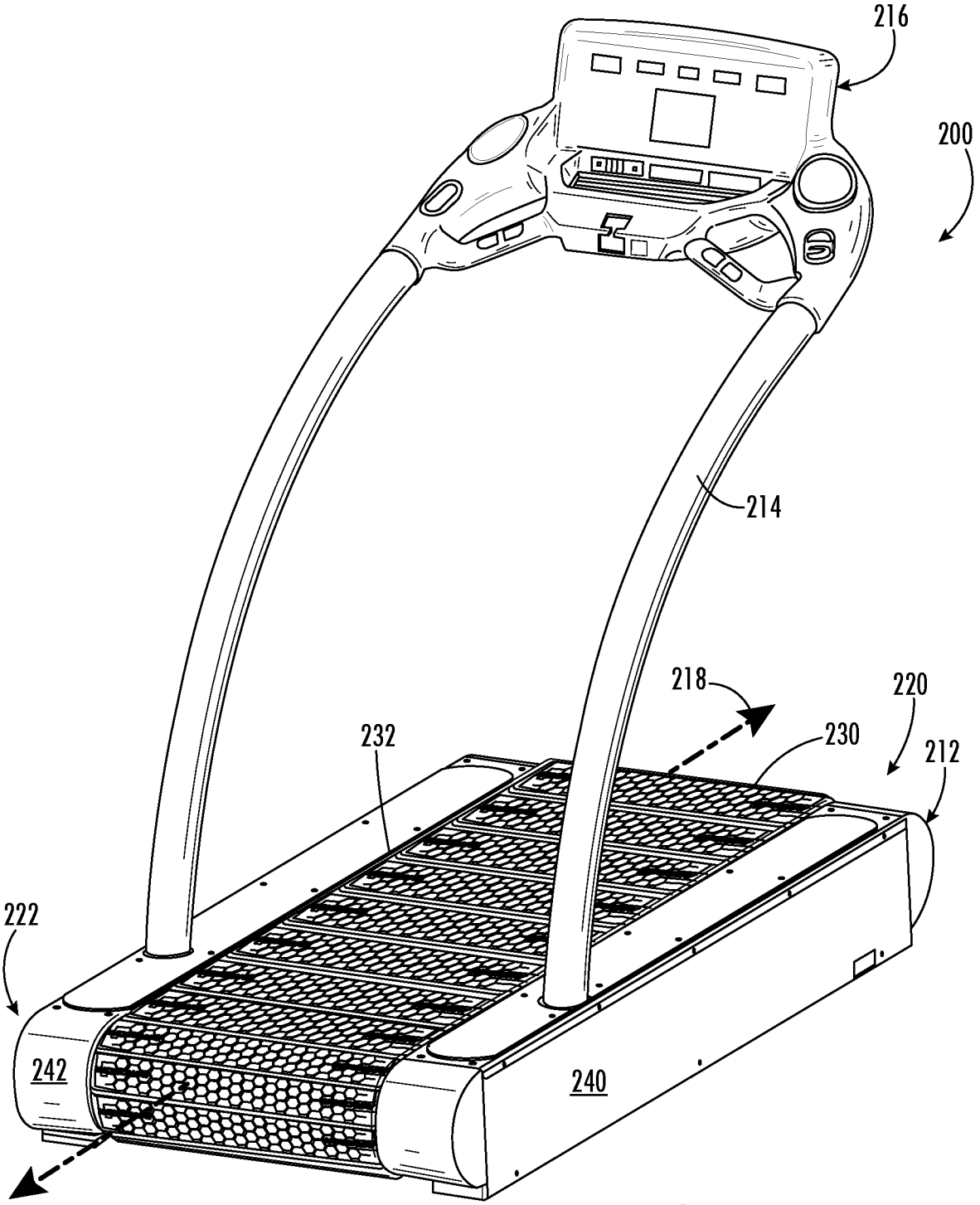
FIG. 3 is a perspective view of a treadmill having a substantially planar running surface, according to an exemplary embodiment.
Figure 4:
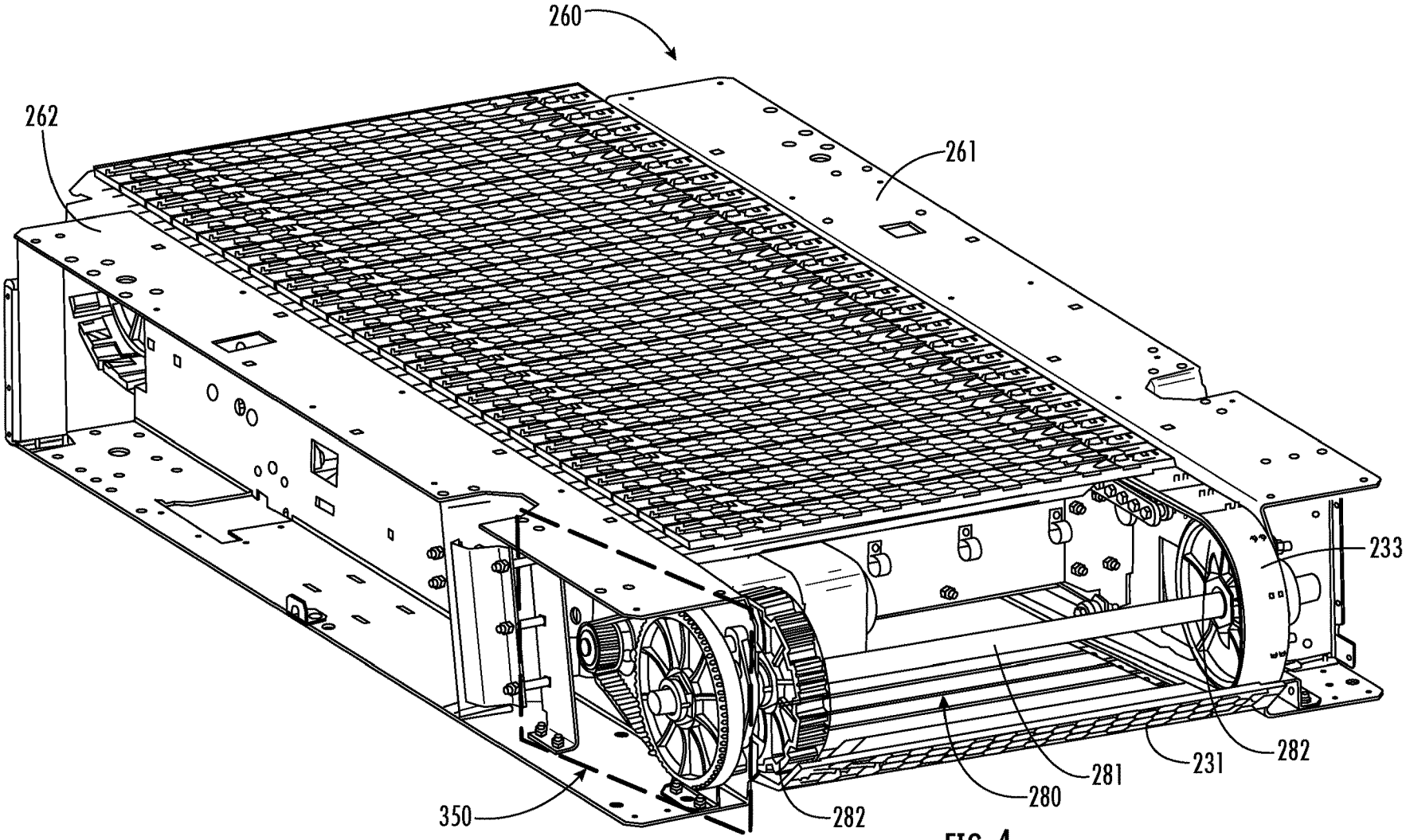
FIG. 4 is a perspective view of the treadmill of FIG. 3 with most of the external, protective covers removed, according to an exemplary embodiment.
Figure 5:
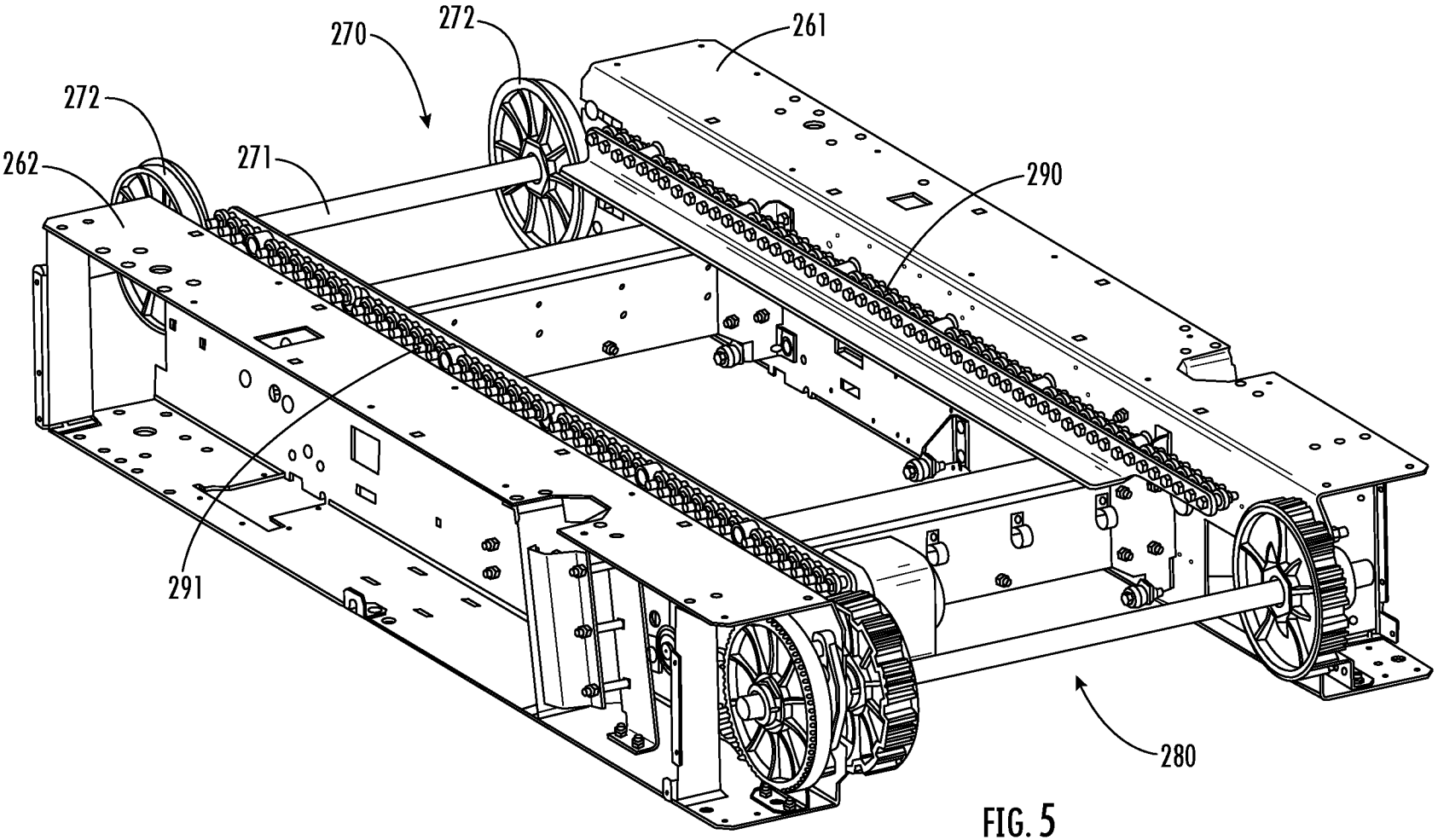
FIG. 5 is another perspective view of the treadmill of FIG. 3 with most of the external, protective covers removed as well as the running belt, according to an exemplary embodiment.
Figure 6:
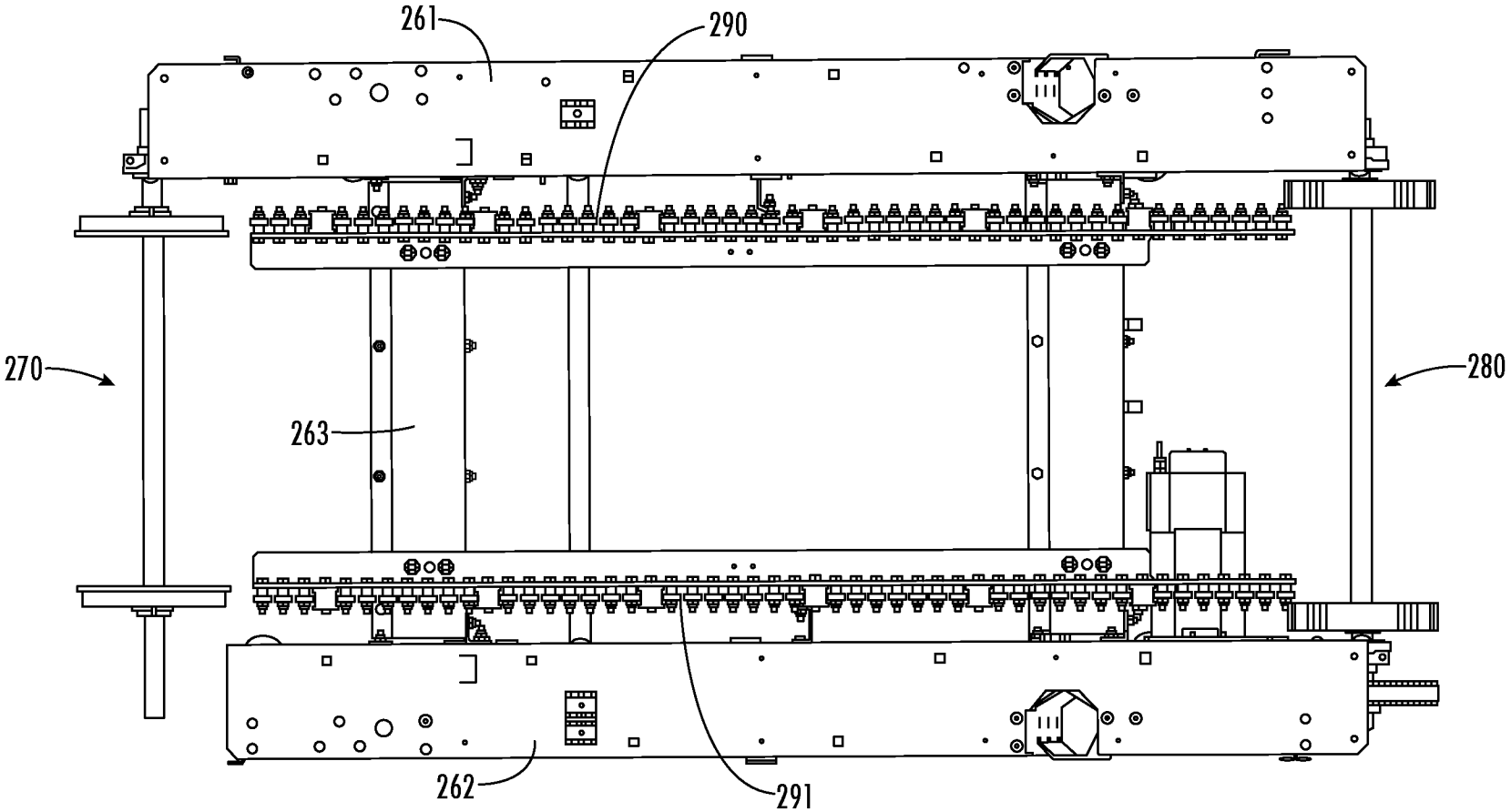
FIG. 6 is a top view of the treadmill of FIG. 5, according to an exemplary embodiment.
Figure 15:
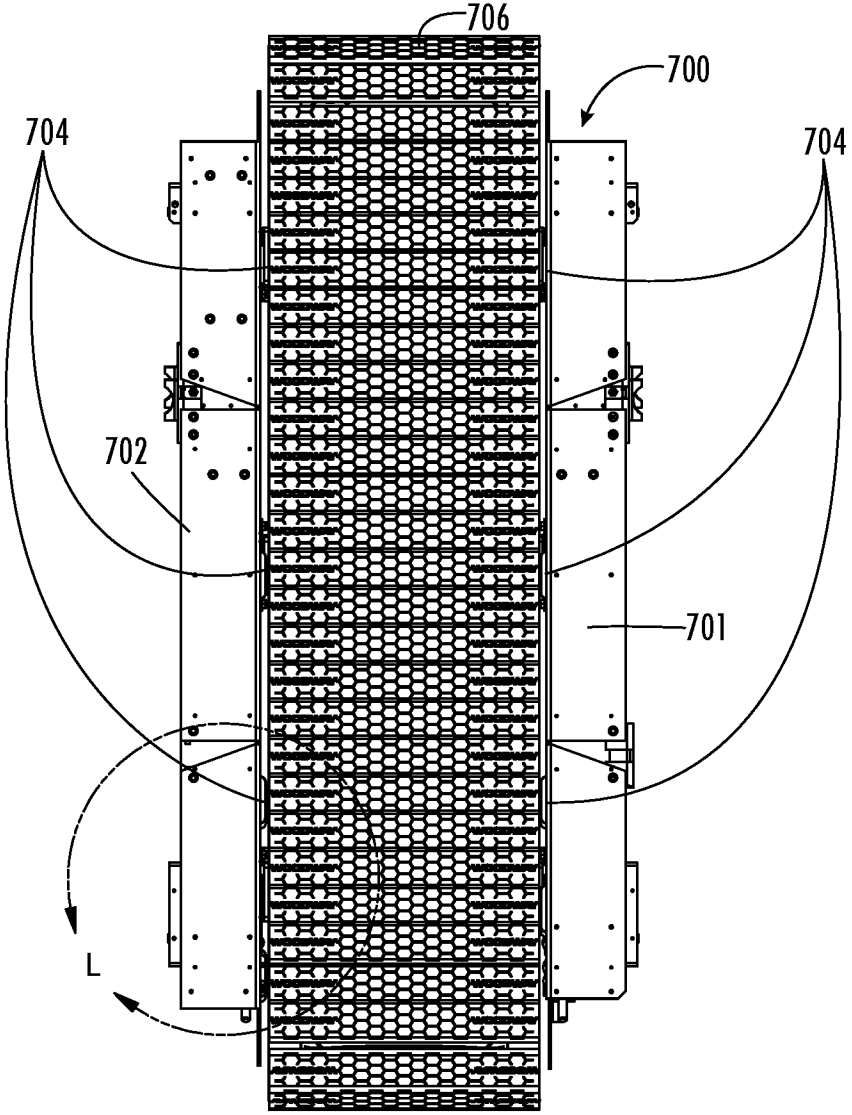
FIG. 15 is a top view of the treadmill of FIG. 13, according to an exemplary embodiment.
Figure 13:
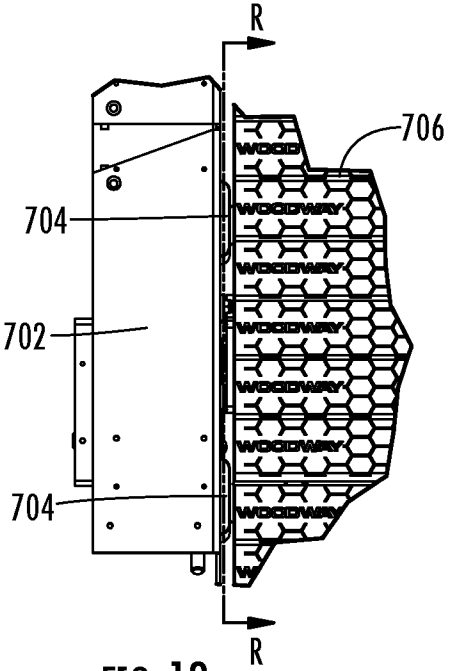
FIG. 13 is a top view of a portion of a treadmill, according to an exemplary embodiment.
Figure 14:
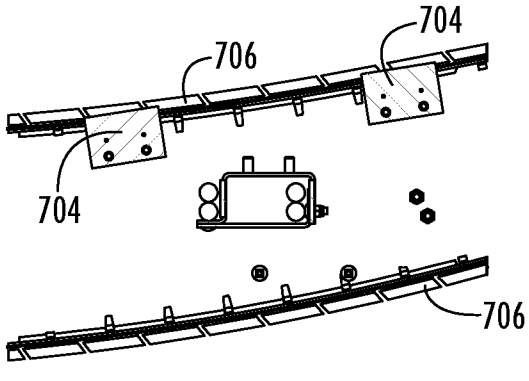
FIG. 14 is a side view of the portion of the treadmill of FIG. 13, according to an exemplary embodiment.
Figure 16:
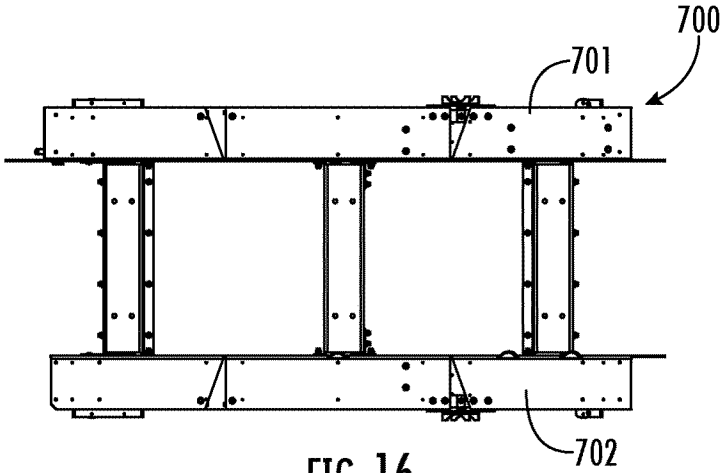
FIG. 16 is a top view of a frame for a treadmill, according to an exemplary embodiment.
Figure 18:
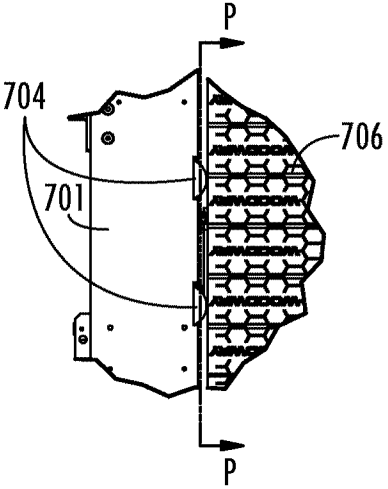
FIG. 18 is a top view of a portion of the treadmill of FIG. 17, according to an exemplary embodiment.
Figure 20:
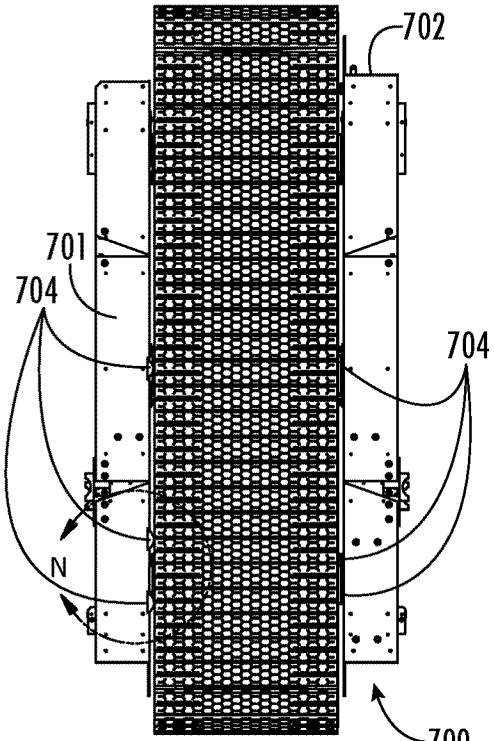
FIG. 20 is a top view of the treadmill of FIG. 17, according to an exemplary embodiment.
Figure 17:
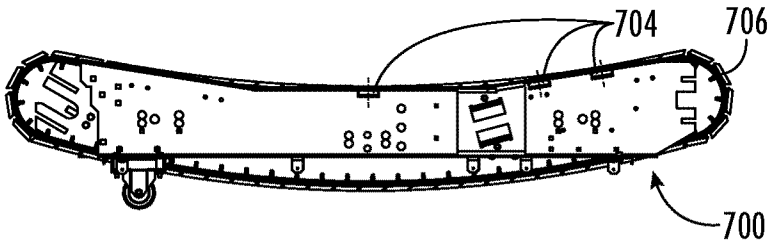
FIG. 17 is a side view of a treadmill, according to an exemplary embodiment.
Figure 19:
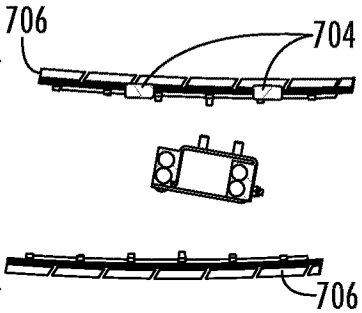
FIG. 19 is a side view of the portion of the treadmill of FIG. 18, according to an exemplary embodiment.

The bumpers as shown and described herein may be implemented with various treadmill types. For example, the bumpers may be implemented with a motorized treadmill, or a non-motorized treadmill Additionally, the bumpers may be implemented with planar treadmills (e.g., a treadmill having a running belt that defines a flat or substantially flat running surface) and non-planar treadmills (e.g., a treadmill having a running belt that defines a non-planar such as a curved running surface), both of which can be motorized or non-motorized. In this regard, FIGS. 1-2 depict a non-planar treadmill while FIGS. 3-6 depict a planar treadmill, according to various embodiments. The bumpers as shown and described herein can be implemented with both of these types of treadmills along with other treadmills not specifically depicted in the drawings. The non-planar and planar treadmill embodiments are firstly described before turning to the description of the bumpers relative to the exemplary treadmill embodiments.

Referring now to FIGS. 1-2, a motorized non-planar treadmill 10 is shown according to an example embodiment. As shown, the treadmill 10 includes a base 12, a handrail 14 mounted or coupled to the base 12, a display device 16 coupled to the handrail 14, a running belt 30 that extends substantially longitudinally along a longitudinal axis 18, a pair of side panels 40 and 42 (e.g., covers, shrouds, etc.) that are provided on the right and left side of the base 12, a pair of rearward positioned feet 52 (i.e., proximate the rear end 22), a pair of forward positioned feet 52 (i.e., proximate the front end 20), and a pair of wheels 54 (e.g., casters, rollers, etc.) positioned proximate the front end 20). The longitudinal axis 18 extends generally between a front end 20 and a rear end 22 of the treadmill 10; more specifically, the longitudinal axis 18 extends generally between the centerlines of a front shaft and a rear shaft, which will be discussed in more detail below. The side panels 40 and 42 may shield the user from the components or moving parts of the treadmill 10. The base 12 is supported by multiple support feet 50 and 52, while the pair of wheels 54 enable a user to grip a handle (not shown) of the base 12 to relatively easily move the treadmill 10. In use, the wheels 54 of the treadmill 10 are supported above a support surface; the wheels 54 may contact the ground to thereby permit the user to easily roll the entire treadmill 10 when desired. It should be noted that the left and right-hand sides of the treadmill and various components thereof are defined from the perspective of a forward-facing user standing on the running surface of the treadmill 10.

A display device 16 may be adapted to calculate and display performance data relating to operation of the treadmill 10 according to an exemplary embodiment. The display device 16 may include any type of display device including, but not limited to, touchscreen display devices, physical input devices in combination with a screen, and so on. The display device 16 may include an integrated power source (e.g., a battery), or be electrically coupled to an external power source (e.g., via an electrical cord that may be plugged into a wall outlet). The feedback and data performance analysis from the display may include, but are not limited to, speed, time, distance, calories burned, heart rate, etc. According to other exemplary embodiments, other displays, cup holders, cargo nets, heart rate grips, arm exercisers, TV mounting devices, user worktops, and/or other devices may be incorporated into the treadmill. Further and as shown, the display device 16 may include a plurality of input devices (e.g., buttons, switches, etc.) that enable a user to provide instructions to the treadmill 10 and to control the operation thereof.

As shown in more detail in FIG. 2, the base 12 includes a frame 60 which preferably is an assembly of elements such as longitudinally-extending, opposing side members, shown as a right-hand side member 61 and a left hand side member 62 and one or more lateral or cross-members 63 extending between and coupled to the side members 61 and 62. The frame 60 is adapted to support a front shaft assembly 70 preferably positioned near a front end 20 of the frame 60, a rear shaft assembly 80 preferably positioned near the rear end 22 of frame 60, a plurality of bearings 90 coupled to and extending generally longitudinally along the right-side member 61 of the frame 60, a plurality of bearings 91 coupled to and extending generally longitudinally along the left-side member 62 of the frame 60. The pluralities of bearings 90, 91 are substantially opposite each other about the longitudinal axis 18, and a tension assembly 100 coupled to the frame 60. Each of these components is described herein below.

The front shaft assembly 70 includes a pair of front running belt pulleys 72 coupled to, and preferably directly mounted to, a shaft 71, while the rear shaft assembly 80 includes a pair of rear running belt pulleys 82 coupled to, and preferably directly mounted to, a shaft 81. In operation, multiple bearing assemblies 75 may rotationally couple the front shaft assembly 70 and rear shaft assembly 80 to the frame 60. The bearing assemblies 75 may be structured as any type of bearing assembly configured to support and enable rotation of the shaft assemblies relative to the frame 60 (e.g., thrust bearings, etc.). The front and rear running belt pulleys 72, 82 are configured to facilitate movement/rotation of the running belt 30. As the front and rear running belt pulleys 72, 82 are preferably fixed relative to shafts 71 and 81, respectively, rotation of the front and rear running belt pulleys 72, 82 causes the shafts 71, 81 to rotate in the same direction. The front and rear running belt pulleys 72, 82 may be formed of any material sufficiently rigid and durable to maintain shape under load. According to one embodiment, the material is relatively lightweight so as to reduce the inertia of the pulleys 72, 82. The pulleys 72, 82 may be formed of any material having one or more of these characteristics (e.g., metal, ceramic, composite, plastic, etc.). According to the exemplary embodiment shown, the front and rear running belt pulleys 72, 82 are formed of a composite-based material, such as a glass-filled nylon, for example, Grivory® GV-5H Black 9915 Nylon Copolymer available from EMS-GRIVORY of Sumter, SC 29151, which may save cost and reduce the weight of the pulleys 72, 82 relative to metal pulleys. To prevent a static charge due to operation of the treadmill 10 from building on a pulley 72, 82 formed of electrically insulative materials (e.g., plastic, composite, etc.), an antistatic additive, for example Antistat 10124 from Nexus Resin Group of Mystic, CT 06355, maybe may be blended with the GV-5H material. Alternatively, the pulleys 72, 82 may be formed of a relatively heavy or high mass material (e.g., metal, ceramic, composite, etc.) if it is desired to create a support structure which has a relatively high inertia as the user generates rotation of the running belt.

The pluralities of bearings 90, 91 are attached or coupled to the frame 60 and structured to support or at least partially support the running belt 30 and to facilitate movement thereof. In this regard, the pluralities of bearings 90, 91 may be arranged to facilitate a desired shape or contour of the running surface 32 of the running belt 30. Accordingly, the running belt 30 assumes a shape that substantially corresponds to the shape of the profile of the pluralities of the bearings 90, 91. The bearings 90, 91 are configured to rotate to thereby decrease the friction experienced by the running belt 30 as the belt moves or rotates relative to the frame 60. The tension assembly 100 may be structured to selectively adjust a position of the rear shaft assembly 80 to add, reduce, and generally control a tension applied to the running belt 30. An exemplary structure of the bearings 90, 91 and tension assembly 100, components that may be included therewith, and arrangements therefor (e.g., relative positions on the treadmill) is described in U.S. patent application Ser. No. 15/765,681, filed Apr. 3, 2018, which is incorporated herein by reference in its entirety. In this regard, the tension assembly may cooperate with a slot (e.g., slot 91 of U.S. patent application Ser. No. 15/765,681) that is curve-shaped, linear-shaped, or non-linear shaped.

As shown, the running belt 30 is disposed about the front and rear running belt pulleys 72, 82, and at least partially supported by at least some of the pluralities of bearings 90, 91. The running belt 30 includes a plurality of slats 31 and defines a non-planar running surface 32 (e.g., curved running surface); hence, the "non-planar" treadmill 10. An example structure of the slats 31 and shape of the running surface 32 is described in U.S. patent application Ser. No. 15/765,681, filed Apr. 3, 2018, which is incorporated herein by reference in its entirety.

As also shown, the treadmill 10 includes a motor system. The motor system is structured to selectively provide power or rotational force to the running belt 30 to operate the treadmill 10. As shown, the motor system includes a motor attached or coupled to the frame 60 (particularly, the left-hand side member 62) by a bracket 76 (e.g., housing, support member, etc.). The motor includes an output shaft which is rotatably coupled to a drive pulley that is rotatably coupled to a driven pulley by a motor belt (not shown). As shown, the motor system cooperates with the front shaft assembly 70. In particular, the driven pulley is coupled to the front shaft 71, such that rotation of the driven pulley causes rotation of the front shaft 71 (and, in turn, the front running belt pulleys 72). However, in other embodiments, the motor system may cooperate with the rear shaft assembly (e.g., the driven pulley may be rotationally coupled to the rear shaft) and/or multiple motor systems may be included whereby the motor systems are included in various positions with various connections to various components of the treadmill. While a motor belt is shown to translate the drive force/braking action of the motor to the running belt, it is to be understood that any conventional means for interconnecting the motor to the running belt including gears, chains, and the like may be used in addition to or in place of the motor belt.

The motor may be structured as any type of motor that may be used to selectively power (e.g., impart force to or otherwise drive rotation of) the running belt 30. In this regard, the motor may be an alternating current (AC) motor or a direct current (DC) motor and be of any power rating desired. In one embodiment, the motor is structured as brushless DC motor in order to be able to selectively provide a driving force. Further, the motor may receive electrical power from an external source (e.g., from a wall outlet) or from a power source integrated into the treadmill, such as a battery. Additionally, the motor may be solely a motor or be a motor/generator combination unit (i.e., capable of generating electricity). Similarly, the drive pulley, driven pulley, and belt may be structured as any type of pulley and belt combination. For example, in one embodiment, the belt may be structured as a toothed belt. In another example, the belt may be structured as a v-shaped belt. In yet another example, the belt may be structured as a substantially smooth belt. In each configuration, the configuration of the pulleys may correspond (e.g., a v-shaped pulley to correspond with a v-shaped belt) with the structure of the belt. Moreover and as shown, the drive pulley is of a relatively larger size (e.g., diameter) than the driven pulley. In another embodiment, the driven pulley is of a relatively larger size (e.g., diameter) than the drive pulley. In still other embodiments, the driven pulley and drive pulley are of substantially similar sizes (e.g., diameters). Differing diameters of the drive pulley in comparison to the driven pulley varies the speed differential between the two pulleys, which may be used to achieve a desired speed ratio for the treadmill 10. Thus, those of ordinary skill in the art will readily recognize and appreciate the wide variety of structural configurations of the motor system, with all such variations intended to fall within the scope of the present disclosure.

While the treadmill of FIGS. 1-2 is shown to include a motor system, in other embodiments, the motor may be removed and the treadmill may be solely manually powered (i.e., powered by the user of the treadmill) In this regard, the user solely causes the running belt 30 to rotate.

Before turning to the description of the treadmill bumper, as mentioned above, the systems and methods described herein may also be implemented with planar or substantially planar motorized or non-motorized treadmills. Therefore, turning now to FIGS. 3-6, a planar motorized treadmill 200 is shown according to an example embodiment. The planar motorized treadmill 200 may be substantially similar as the non-planar motorized treadmill 10 except that the running surface of the running belt of the treadmill 200 is substantially planar in nature (e.g., flat, not-curved, etc.). While the incline of the running surface may change with either the treadmill 10 or treadmill 200, the characteristic planar feature of the treadmill 200 remains constant. Thus, to ease explanation of the treadmill 200, similar reference numbers are used with FIGS. 3-6 as were used in FIGS. 1-2 with the treadmill 10 except with the prefix "2" (with the notable exception of reference number 200 being used from the treadmill of FIGS. 3-6 compared to the reference number 10 for the treadmill of FIGS. 1-2). In this regard, similar reference numbers are used to denote similar components unless context indicates otherwise or unless explicitly described otherwise.

In this regard and referring collectively to FIGS. 3-6, the planar motorized treadmill 200 includes a base 212, a handrail 214 mounted or coupled to the base 212, a display device 216 coupled to the handrail 214, a running belt 230 that extends substantially longitudinally along a longitudinal axis 218, a pair of side panels 240 and 242 (e.g., covers, shrouds, etc.) that are provided on the right and left side of the base 212, and a frame 260 including a right-hand side member 261 and a left-hand side member 262 disposed substantially longitudinally opposite the right-hand side member 261. One or more cross-members, such as cross-members 263, may be used to join, couple, or otherwise connect the right-hand and left-hand side members 261, 262 together. The longitudinal axis 218 extends generally between a front end 220 and a rear end 222 of the treadmill 200. The side panels 240 and 242 may shield the user from the components or moving parts of the treadmill 200. Like the treadmill 10, it should be noted that the left and right-hand sides of the treadmill and various components thereof are defined from the perspective of a forward-facing user standing on the running surface of the treadmill 200. It should also be noted that similar support feet and wheels as described herein with respect to the treadmill 10 may also be included with the treadmill 200.

Like the treadmill 10, the treadmill 200 includes a pair of front running belt pulleys 272 coupled to, and preferably directly mounted to, a shaft 271, and a rear shaft assembly 280 includes a pair of rear running belt pulleys 282 coupled to, and preferably directly mounted to, a shaft 281. The front and rear running belt pulleys 272, 282 are configured to facilitate rotational movement of the running belt 230, and may be rotationally coupled to the frame 260 by multiple bearing assemblies (not shown). As the front and rear running belt pulleys 272, 282 are preferably fixed relative to shafts 271 and 281, respectively, rotation of the front and rear running belt pulleys 272, 282 causes the shafts 271, 281 to rotate in the same direction.

As also shown, the treadmill 200 may include a plurality of bearings 290 coupled to and extending longitudinally along the right-side member 261 of the frame 260, and a plurality of bearings 291 coupled to and extending longitudinally along the left-hand side member 262 of the frame 260 such that the pluralities of bearings 290, 291 are substantially opposite each other about the longitudinal axis 218. Relative to the pluralities of bearings 290, 291, the pluralities of bearings 290, 291 are arranged in a substantially planar configuration to at least partly support the running belt 230 in the substantially planar orientation/configuration.

As shown, the running belt 230 is disposed about the front and rear running belt pulleys 272, 282, and at least partially supported by the bearings 290, 291. The running belt 230 includes a plurality of slats 231 and defines a planar or substantially planar running surface 232 (e.g., non-curved running surface); hence, the "planar" treadmill 10. An example structure of the slats 231 is described in U.S. patent application Ser. No. 15/765,681, filed Apr. 3, 2018, which is incorporated herein by reference in its entirety. However, in other embodiments, the running belt 230 and running belt 30 may be constructed as an endless belt, also referred to as a closed-loop treadmill or running belt (e.g., a non-slat embodiment). The running belt 230 includes an endless belt 233, which interfaces with or engages with a front running belt and a rear running belt pulley. Another endless belt (not shown) engages with the other front running belt pulley and rear running belt pulley. The endless belts 233 may be supported by the plurality of bearings 290, 291, respectively. Further details regarding example configurations of the endless belts 233 are provided in U.S. patent application Ser. No. 14/832,708 and related applications, which is incorporated herein by reference in its entirety.

Similar to the treadmill 10, the treadmill 200 is motorized and includes a motor system 350. The motor system 350 is structured to selectively provide power, to not provide power, or to provide braking to resist rotational movement of the running belt 230 as the treadmill 200. As shown, the motor system 350 includes a motor attached or coupled to the frame 260 (particularly, the left-hand side member 262) by a bracket (e.g., housing, support member, etc.) and has an output shaft, a drive pulley, and a driven pulley coupled to the drive pulley by a motor belt (not shown). As shown, the motor system 350 is in cooperation with the rear shaft assembly 280. In particular, the driven pulley is coupled to the rear shaft 281, such that rotation of the driven pulley causes rotation of the rear shaft 281 (and, in turn, the rear running belt pulleys 282). However, in other embodiments, the motor system 350 may be in cooperation with the front shaft assembly (e.g., the driven pulley may be rotationally coupled to the rear shaft) and/or multiple motor systems may be included whereby the motor systems are included with the treadmill.

As mentioned above and described herein, bumpers (e.g., pads, spacers, impact elements or members, guide elements or members, glides, etc.) may be used with motorized or non-motorized planar and non-planar treadmills like those shown in FIGS. 1-2 and 3-6. In this regard, one or more bumpers may be coupled to medial surfaces (e.g., proximate a longitudinal middle portion of the frame 60 relative to the longitudinal axis 18) of the frame 60 and in particular, to the right-side member 61 and the left-side member 62. The bumpers may be coupled to only one of the two side members 61, 62, or coupled to both. When coupled to the left and right-side members 62 and 61, the bumpers extend laterally inward towards the opposite side member. For example, a bumper coupled to the medial surface of the right-side member 61 extends inwards towards the left-side member 62. Similarly, a bumper coupled to the medial surface of the left-side member 62 extends inwards towards the right-side member 61. A similar arrangement is used with the treadmill 200. The purpose of the bumpers is to assist in guiding or maintaining accurate and consistent tracking or rotation of the running belt 30 in relation to the frame. Accordingly, the running belt 30 and 230 can be retained in a desired position (e.g., the running belt 30 positioned with the lateral edges substantially equidistant between the right-side member 61 and the left-side member 62) during operation of the treadmill By retaining the running belt 30 in the desired position during operation, the bumpers may prevent longitudinally transverse movement (e.g., in a direction substantially perpendicular to the longitudinal axis 18) of the running belt 30 and further prevent uneven wear or damage to the running belt 30.

Referring now to FIGS. 7-23, bumpers for a treadmill are shown according to various embodiments. The bumpers 704 are shown to be coupled to a right hand side member 701 and a left hand side member 702 of a treadmill frame (which can be the same as or similar to the right-side member 61 and left-side member 62 as shown and described with reference to the treadmill 10, or the right-side member 261 and the left-side member 262 of the treadmill 200). The bumpers 704 are coupled to an inside portion of the right-side member 701 and left-side member 702, such that the bumpers 704 are arranged between the right-side member 701 and the running belt 706 on one side of the running belt 706, and between the left-side member 702 and the running belt 706 on the opposite side of the running belt 706. Accordingly, the bumpers 704 retain or substantially retain the running belt 706 in the desired alignment or position relative to the left and right-side members of the treadmill frame (e.g., lateral edges of the running belt 706 equidistant the right-side member 701 and the left-side member 702).

The bumpers 704 may be coupled to the right-side member 701 and left-side member 702 through one or more of a variety of means. For example, the bumpers 704 may be mechanically coupled to the right-side member 701 and left-side member 702 by one or more mechanical fasteners (e.g., bolts and nuts, screws, nails, rivets, etc.). In another embodiment, the bumpers 704 may be coupled to the frame using adhesive (e.g., epoxy, glue, etc.). In still another embodiment, the bumpers 704 may be coupled to the frame using a mechanical connection means (e.g., a protrusion of the bumper may snap into an opening of the frame to avoid the use of extra components). In yet another embodiment, any combination of the aforementioned ways may be used to mount or couple the bumpers 704 to the treadmill frame (particular, the left and right-side members). In the example shown, the bumpers 704 are coupled to the right-side member 701 and left-side member 702 such that a space or gap exists between a lateral edge of the running belt 706 and the bumper 704. In other embodiments, the bumpers 704 may be configured to contact, and preferably, only lightly contact the running belt 706 during operation.

As shown in FIGS. 7-20 the bumpers 704 are disposed variously along the right-side member 701 and left-side member 702 of the frame 700. Each of the bumpers 704 is shown to be coupled to an upper portion of the right-side member 701 and left-side member 702 such that a top surface of each of the bumpers 704 is substantially flush (i.e., coplanar) or adjacent to a top surface of the right-side member 701 and left-side member 702. Accordingly, the bumpers 704 are arranged so that the bumpers 704 do not protrude vertically above the upper portion of the right-side member 701 and left-side member 702. As shown in FIGS. 7-20, the right-side member 701 and left-side member 702 each includes three bumpers 704. Preferably, each of the bumpers 704 of FIGS. 7-20 is coupled opposite the frame 700 from a corresponding bumper 704 provided on the opposite frame member (but this opposing arrangement is not required). For example, a bumper coupled to the right-side member 701 is arranged opposite a bumper coupled to the left-side member 702 such that the bumpers on the left side mirror the arrangement of the bumpers on the right side. As shown, the bumpers 704 may be coupled to substantially flat portions of the right-side member 701 and the left-side member 702 (e.g., the middle portion as shown in FIGS. 7, for example). However, the bumpers 704 may also be coupled to angled portions of the right-side member 701 and left-side member 702 (e.g., the portions of the right-side member 701 and left-side member 702 nearest the front and rear of the frame 700 relative to the wheels). Additionally, the bumpers 704 are disposed substantially along a front portion or half of the right-side member 701 and left-side member 702 (e.g., the portion or half of the right-side member 701 and left-side member 702 closest to the wheels 54 of the treadmill 10, with reference to FIG. 1). Conversely, the bumpers 704 as shown in the exemplary embodiment of FIGS. 10-12 are disposed substantially along a rear portion or half of the right-side member 701 and left-side member 702 (e.g., the portion or half of the right-side member 701 and left-side member 702 opposite that closest to the wheels 54 of the treadmill 10, with reference to FIG. 1).

Figure 21:
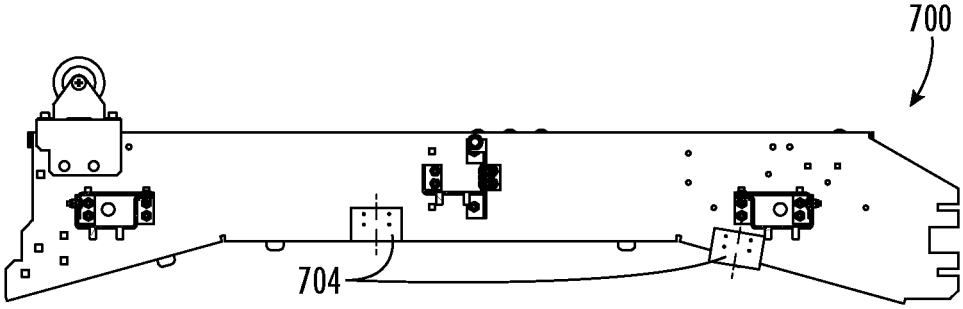
FIG. 21 is a side view of a treadmill frame, according to an exemplary embodiment.
Figure 22:
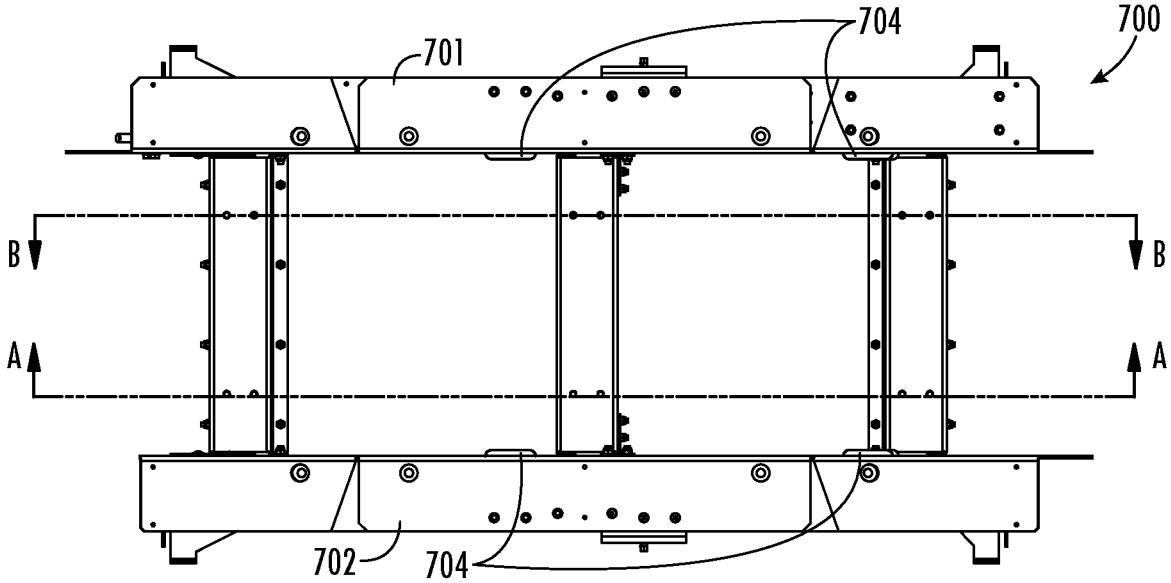
FIG. 22 is a top view of the treadmill frame of FIG. 21, according to an exemplary embodiment.
Figure 23:
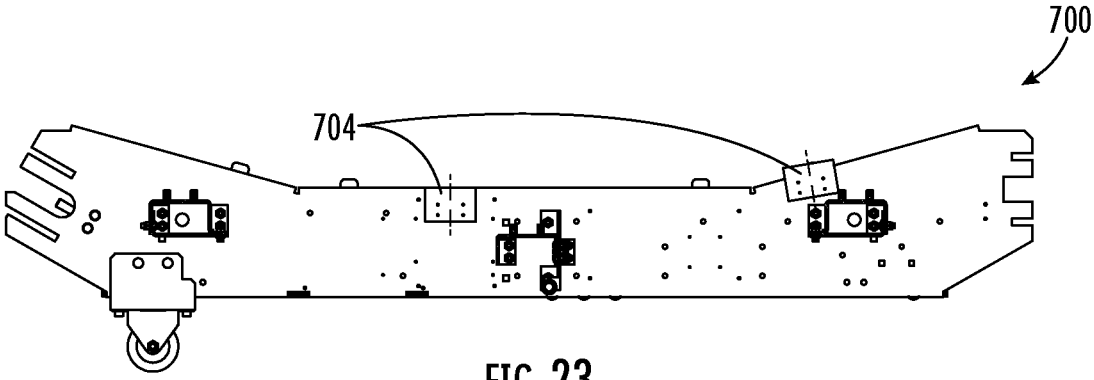
FIG. 23 is an additional side view of the treadmill frame of FIG. 21, according to an exemplary embodiment.

Referring now to FIGS. 21-23, the bumpers 704 are shown about the frame 700 in an arrangement different from that of FIGS. 7-20. FIGS. 21-23 include the bumpers 704 coupled to the right-side member 701 and left-side member 702 similar to that shown in FIGS. 7-20 but in an alternate arrangement. FIGS. 21-23 are shown to include a pair of bumpers 704 coupled to each of the right-side member 701 and left-side member 702 with a first bumper 704 coupled to a flat portion of the right-side member 701 and left-side member 702 and a second bumper 704 coupled to an angled portion of the right-side member 701 and left-side member 702. Similar to the exemplary embodiments of FIGS. 7-20, the bumpers 704 are arranged and coupled to the right-side member 701 and left-side member 702 substantially opposite one another. Contrary to FIGS. 7-20, FIGS. 21-23 show the bumpers 704 coupled to middle and rear portions of the right-side member 701 and left-side member 702 relative to a rear portion of the frame 700 (relative the wheels of the frame 700). However, in some embodiments the bumpers 704 may be coupled to other portions of the right-side member 701 and left-side member 702 relative the frame 700 (e.g., middle and front portions of the right-side member 701 and left-side member 702). The bumpers 704 as shown in the exemplary embodiment of FIGS. 21-23 may also be of a different size than the bumpers of FIGS. 7-20. For example, in FIGS. 7-20 each of the right-side member 701 and left-side member 702 is shown to include three bumpers 704 all having a common, first size, FIGS. 21-23 show each of the right-side member 701 and left-side member 702 including two bumpers both having a second size. Further to the previous example, the bumpers of the first size as shown in FIGS. 7-20 may be smaller than the bumpers of the second size as shown in FIGS. 21-23. The bumpers can be positioned in any desired arrangement with any desired or varying size depending upon the structure of the treadmill and running belt.

In each of these embodiments, the bumpers 704 are structured to retain the running belt 706 in the desired position and alignment during operation of the treadmill. For example, if the gait of a user on the running belt 706 is unbalanced, the running belt 706 may be subject to a skewing or transverse movement (i.e., towards the left and right-side members 702 and 701). The bumpers 704 are configured such that a portion of the running belt 706 (e.g., one or more slats or other component of the running belt such as the belt used to interconnect the slats) may impact, contact, touch, or otherwise engage with one or more of the bumpers 704 thus limiting the transverse movement of the running belt relative to the frame or side members 701, 702. Accordingly, the bumpers 704 may be configured to prevent uneven wear of the running belt 706 (at least a portion thereof) over time. For example, in the absence of the bumpers 704 the running belt 706 may be subject to longitudinally transverse movement over an extended period of time thus resulting in uneven wear (e.g., a side of the running belt 706 may contacts the right-side member 701 and/or left-side member 702 during operation). As such, the bumpers 704 are configured to prevent said longitudinally transverse movement or misalignment of the running belt 706, thus facilitating even wear of the running belt 706 over an extended period of time.

Referring now to FIGS. 24-28, the bumpers 704 are shown in more detail. The bumpers 704 may be constructed of various materials, such as Delrin, UHMW polymer (e.g., ultra-high molecular weight polyethylene), Nylon, ABS, or other polymers, although other materials may also be used. For example, the material may be chosen to have some resiliency such that if and when the running belt impacts the bumper, the bumper is pliable enough to deflect inward (slightly) yet still provides a counteracting force to push the belt away from the bumper and the side members 701, 702. The slight resiliency may be beneficial to prevent wear from occurring between the bumper and the running belt. In other embodiments, a rigid bumper may be used that does not or likely does not deflect inward when contacted by the running belt. This may be beneficial to quickly push or force the running belt back into a desired position after contact with the bumper.

The bumpers may include structural features to facilitate coupling to the right-side member 701 and left-side member 702 of the frame 700. For example, as shown in FIGS. 24-28 the bumpers 704 include a plurality of apertures 710. The plurality of apertures 710 may be configured to receive one or more components to facilitate the coupling to the frame 700 and in particular, the right-side member 701 and the left-side member 702 by nuts and bolts, screws, rivets, pins, bolts, etc.

Figure 25:
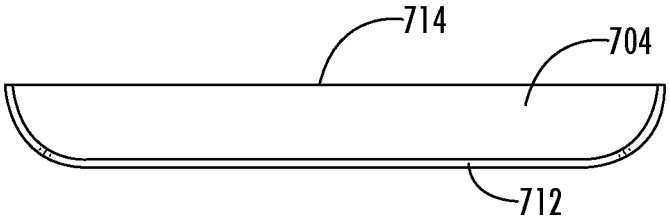
FIG. 25 is a top view of the treadmill bumper of FIG. 24, according to an exemplary embodiment.
Figure 26:
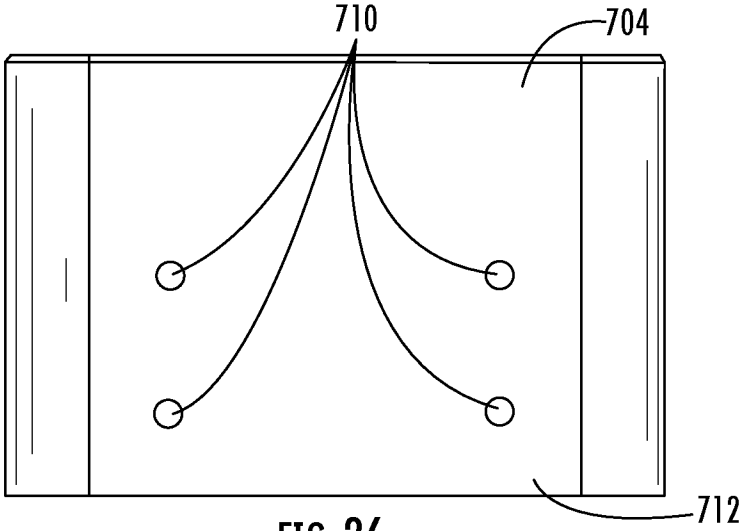
FIG. 26 is a front view of the treadmill bumper of FIG. 24, according to an exemplary embodiment.
Figure 27:
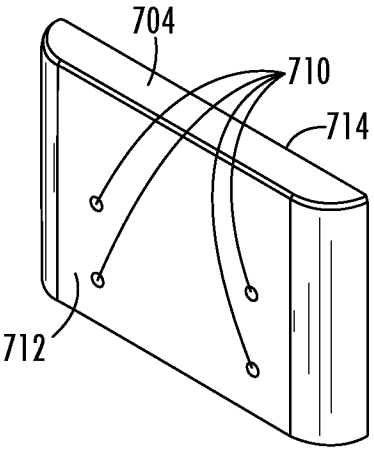
FIG. 27 is a perspective view of the treadmill bumper of FIG. 24, according to an exemplary embodiment.
Figure 24:
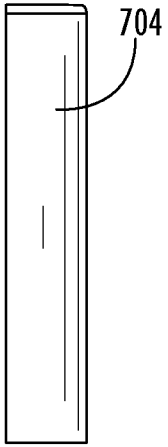
FIG. 24 is a side view of a treadmill bumper, according to an exemplary embodiment.
Figure 28:
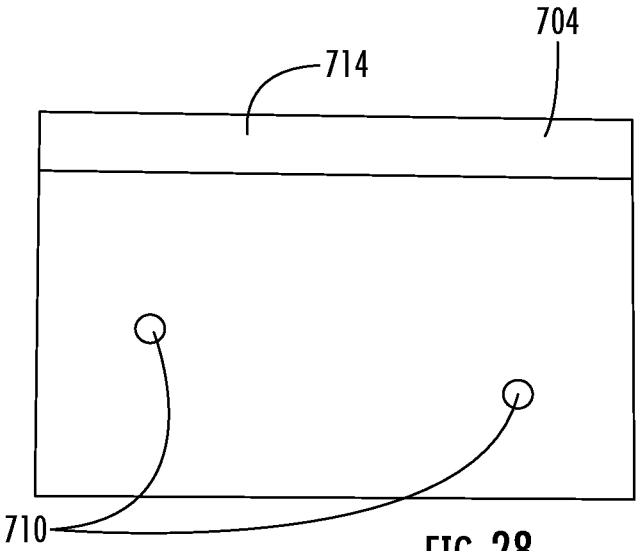
FIG. 28 is a perspective view of a treadmill bumper of FIG. 24, according to an exemplary embodiment.
Figure 29:
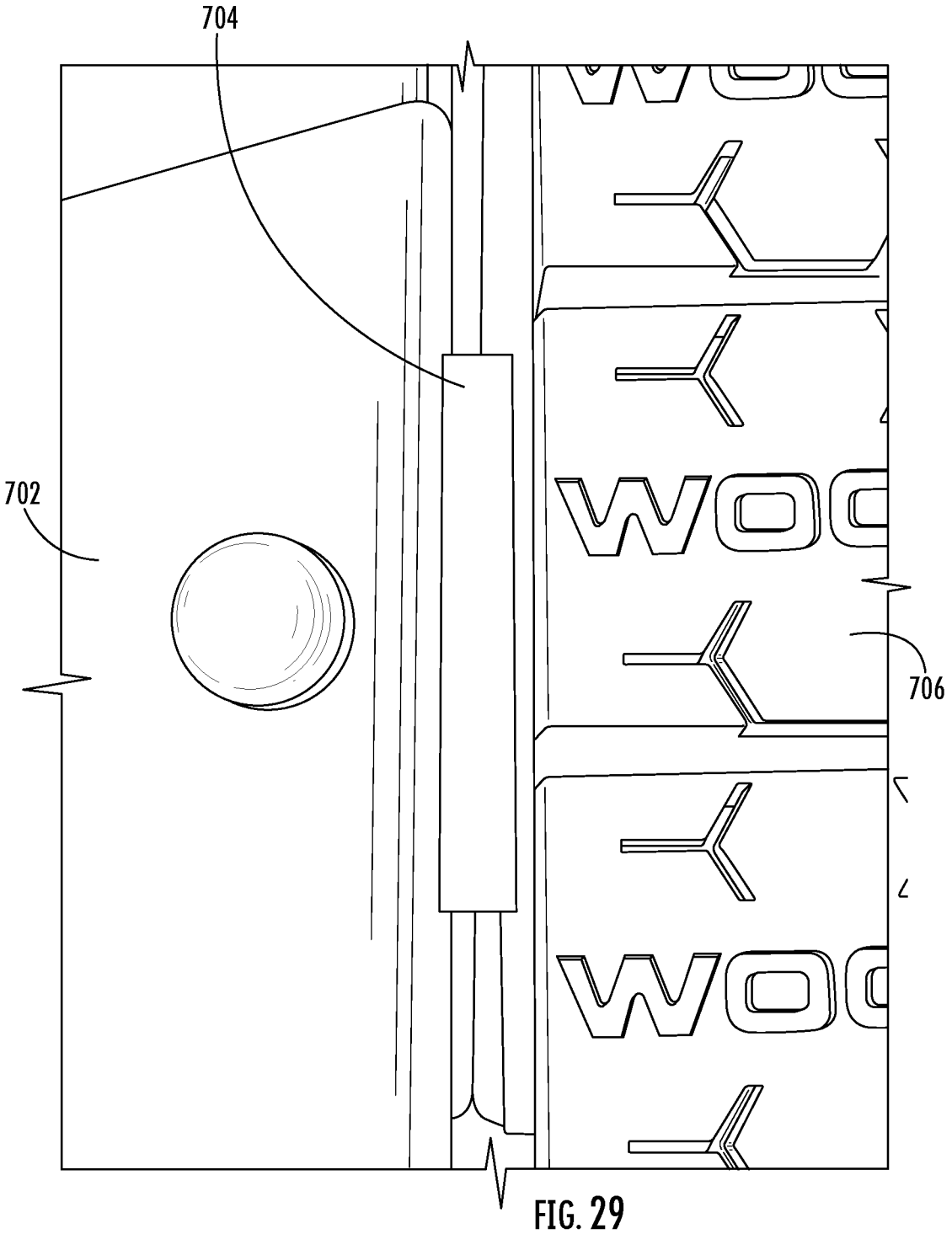
FIG. 29 is a top view of a portion of a treadmill including the treadmill bumper of FIG. 24, according to an exemplary embodiment.
Figure 30:
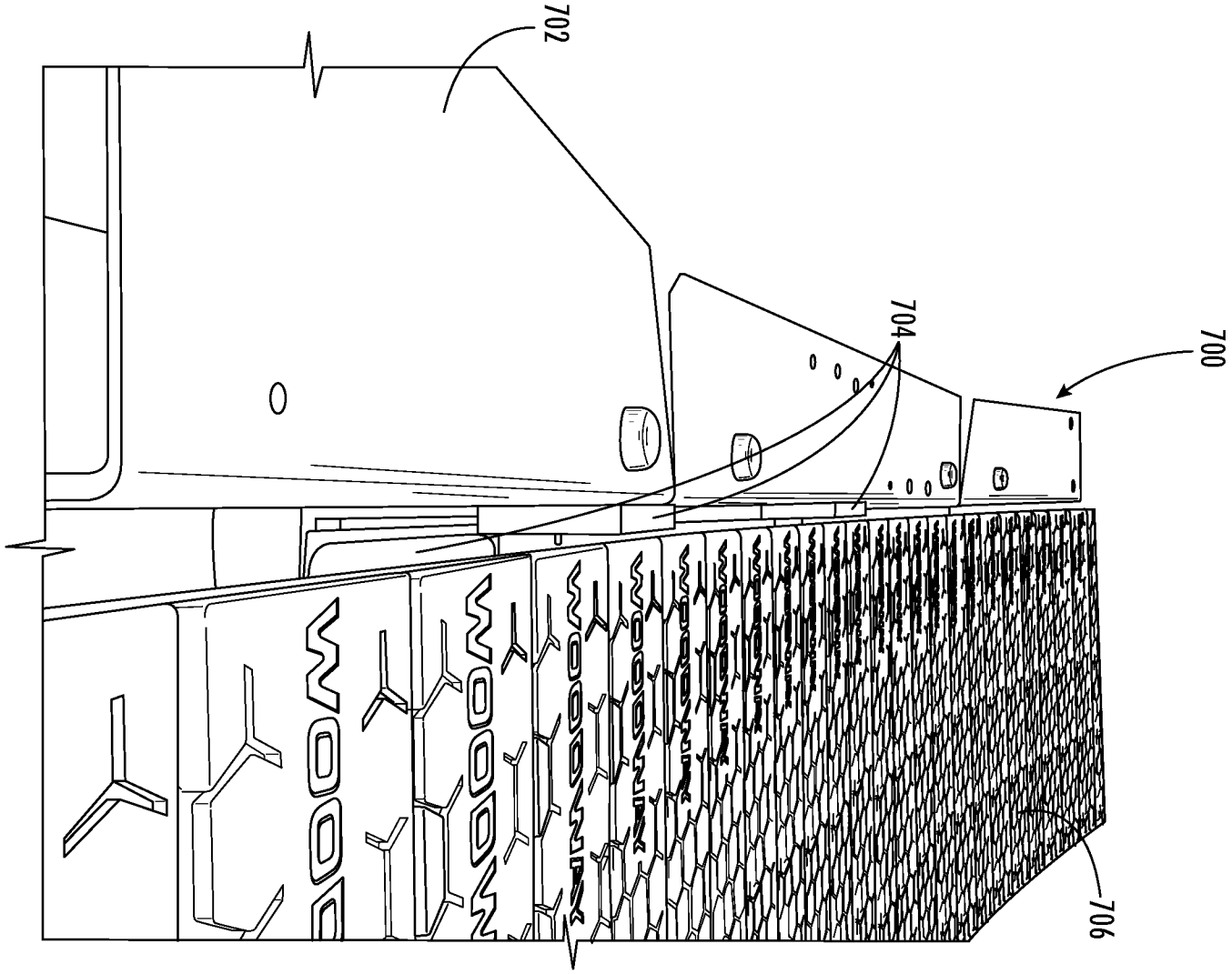
FIG. 30 is a perspective view of the treadmill including the treadmill bumper of FIG. 29, according to an exemplary embodiment.
Figure 31:
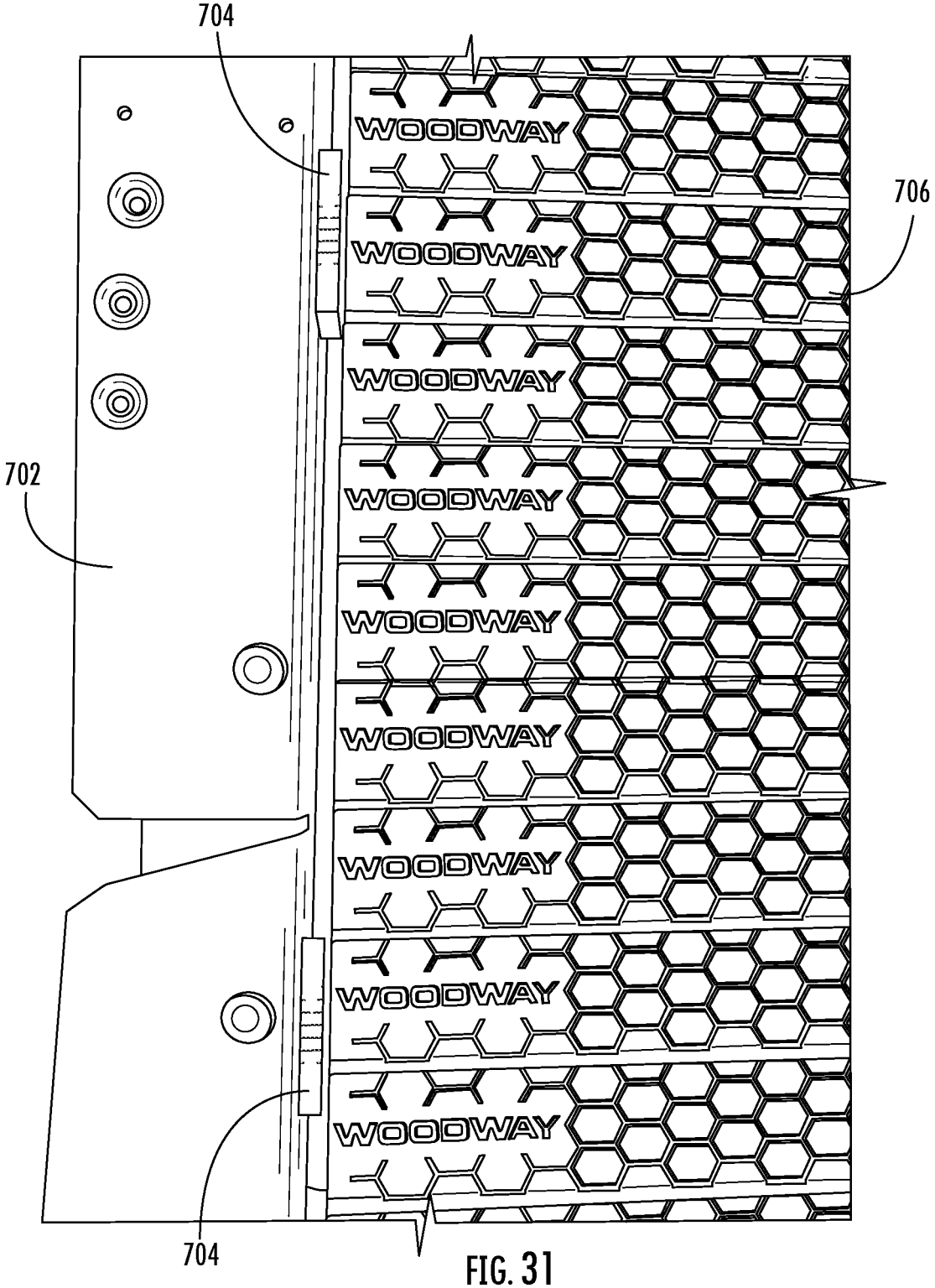
FIG. 31 is an additional top view of the treadmill including the treadmill bumper of FIG. 29, according to an exemplary embodiment.

The shape and size of the bumper 704 may be highly configurable. As shown in FIGS. 25 and 27, the bumpers 704 may include a partially rounded surface positioned 712 opposite a substantially flat surface 714. In some embodiments, the substantially flat surface 714 may be configured to contact a similarly substantially flat surface of the right-side member 701 and left-side member 702 so as to facilitate coupling of the bumpers 704 to the right-side member 701 and left-side member 702. The partially rounded surface 712 may be configured to contact the running belt 706 to prevent misalignment or longitudinally transverse movement thereof. As mentioned above, the bumpers 704 may also comprise one or more different materials. Such different materials may correspond to a function of different portions of the bumpers 704. For example, the partially rounded surface 712 as described previously may be comprised of a material structured to provide minimal wear to the running belt 706 should the running belt 706 contact the bumper 704. Conversely, other portions such as the substantially flat surface 714 of the bumpers 704 may be comprised of different materials, for example a material configured to facilitate coupling to the right-side member 701 and left-side member 702 (e.g., a rigid material conducive to mechanical coupling such as metal, or a material configured to promote adhesive coupling). In some embodiments, all of the bumpers 704 coupled to the right-side member 701 and left-side member 702 of the frame 700 may be of the same shape and size, while in other select embodiments bumpers 704 of various shapes and sizes may be coupled to the right-side member 701 and left-side member 702 of the frame 700.

Referring now to FIGS. 29-32, the bumpers 704 are shown to be coupled to the left-side member 702 of the frame 700 of a treadmill such as the treadmill 10, according to an exemplary embodiment. The running belt 706 is shown to have a plurality of slats, such as the slats 31 of the running belt 30 as shown and described. In some embodiments similar to that shown in FIGS. 28-32, the running belt 706 may be configured otherwise (e.g., without slats). The bumpers 704 are configured between the running belt 706 and either the right-side member 701 or left-side member 702. The medial surface of the bumpers 704 (e.g., the surface closest the running belt 706) and the lateral surface of the running belt 706 (e.g., the edge of the running belt closes the bumpers 704) is configured to selectively engage with each other upon longitudinally transverse movement of the running belt 706. The contact with the bumpers 704 returns the running belt 706 to the desired position or prevents further longitudinally transverse movement of the running belt 706.

Figure 32:
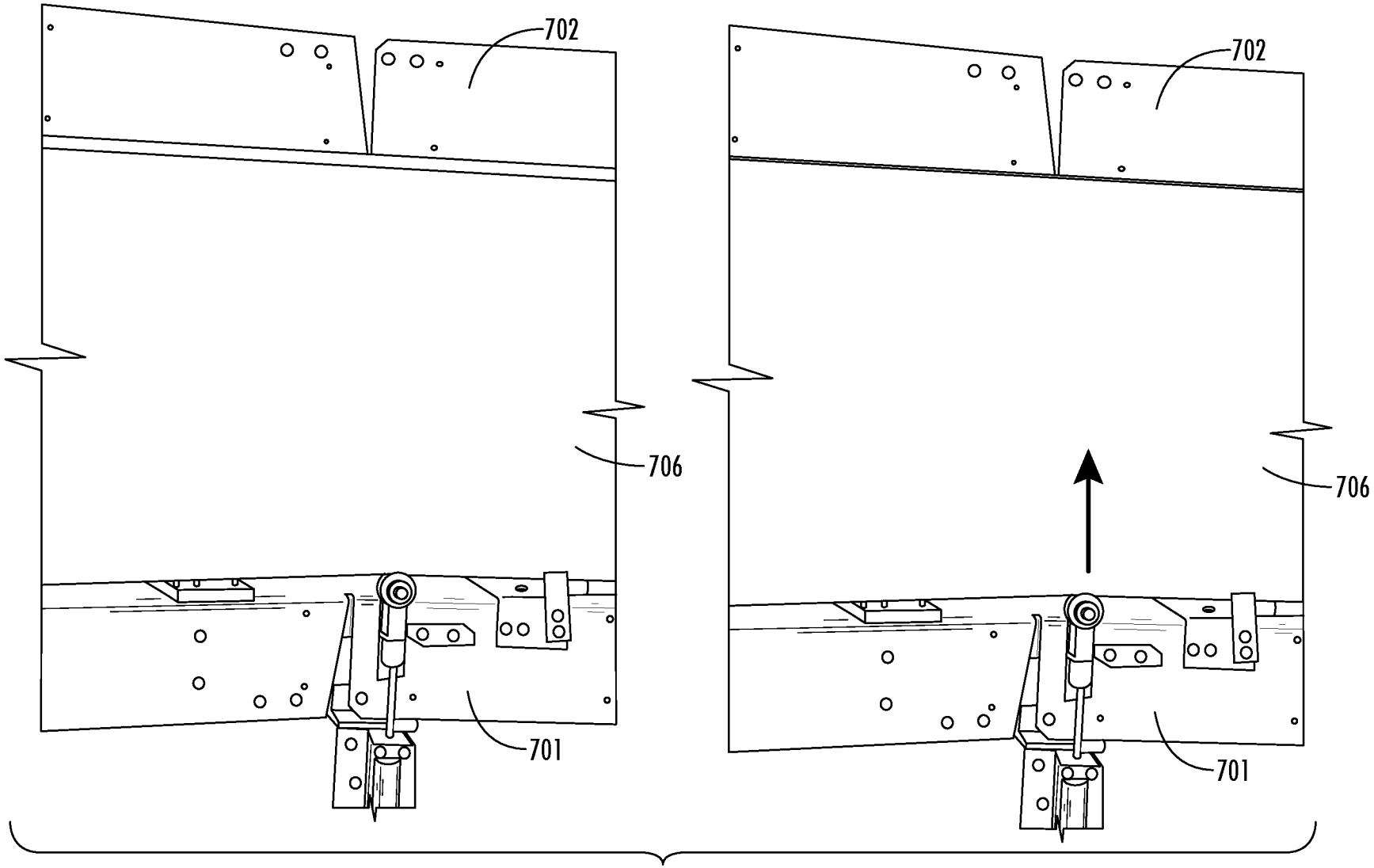
FIG. 32 is a top view of a treadmill without the treadmill bumper of FIG. 24, according to an exemplary embodiment.
Figure 33:
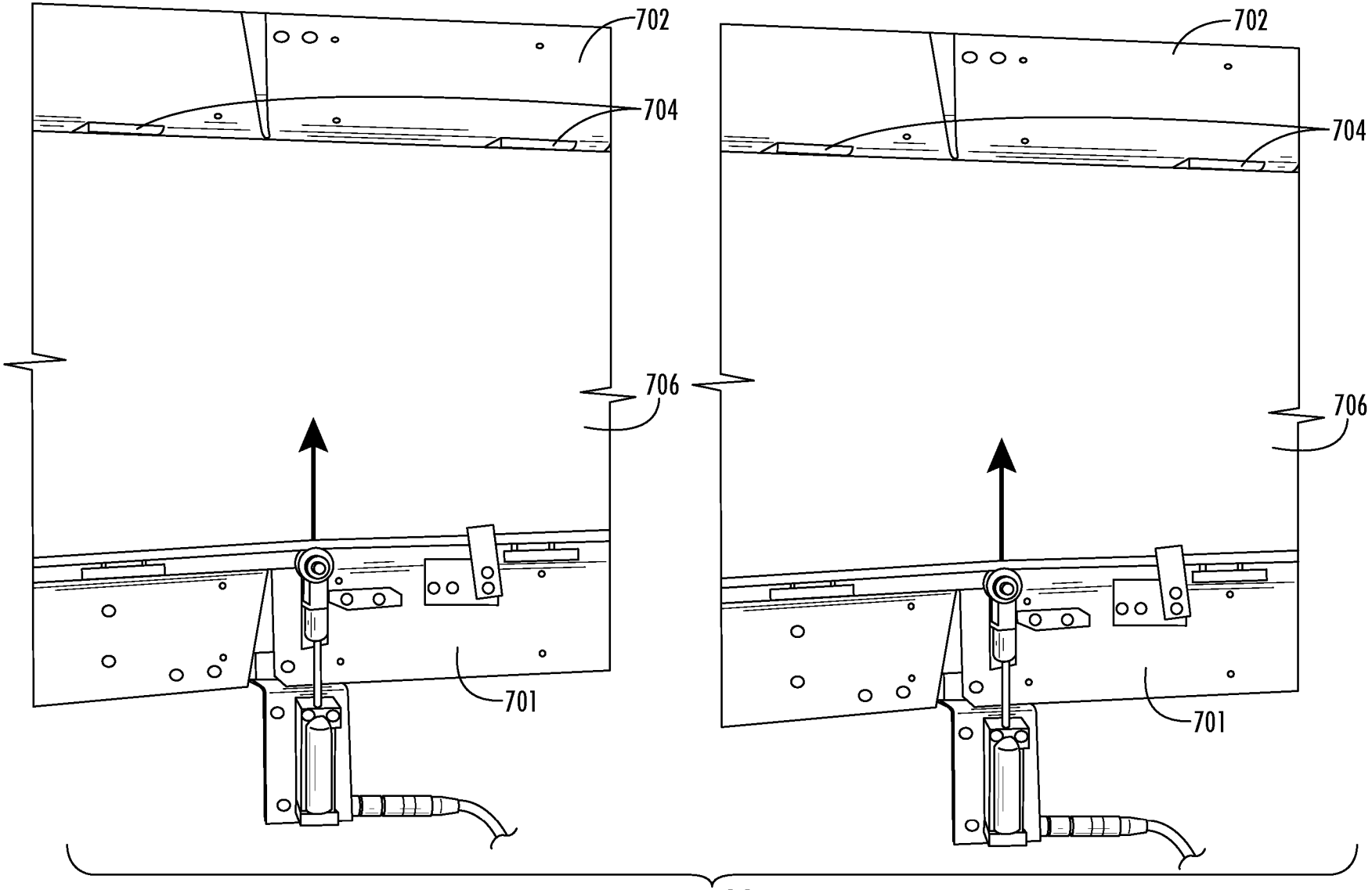
FIG. 33 is a top view of the treadmill of FIG. 32 with the treadmill bumper of FIG. 24, according to an exemplary embodiment.

Referring now to FIGS. 32-33, longitudinally transverse movement of the running belt 706 is shown. For example, in FIG. 32 the running belt 706 is shown to have deviated from the desired position (e.g., centrally positioned with the edges equidistant from the right-side member 701 and left-side member 702) and moved in a longitudinally transverse direction such that an edge of the running belt 706 contacts the left-side member 702. As shown in FIG. 32, the left-side member 702 is absent the bumpers 704, thus resulting in excess and undesirable longitudinally transverse movement of the running belt 706 such that contact with the left-side member 702 occurs. Such movement may result in uneven wear of the running belt 706 (and/or other components of a treadmill such as the treadmill 10), and may also prevent danger to a user in the form of the running belt 706 sustaining damage and/or catching on the left-side member 702 or a portion thereof. As shown in FIG. 33, the right-side member 701 and left-side member 702 are shown to include the bumpers 704. Similar to FIG. 32, the running belt 706 is shown to have moved in a longitudinally transverse direction such that the edges of the running belt 706 are no longer equidistant the right-side member 701 and left-side member 702 (and thus the running belt 706 has deviated from the desired position or alignment). However, contrary to FIG. 32, the running belt 706 is shown to contact the bumpers 704, thus minimizing the longitudinally transverse movement of the running belt 706 relative to the frame. By minimizing the longitudinally transverse movement of the running belt 706, even wear of the running belt 706 is promoted.

The bumpers 704 as shown and described previously may be configured to couple with the right-side member 701 and left-side member 702 of a non-planar (e.g., curved) treadmill (such as the treadmill 10), or with a planar treadmill (e.g., flat/traditional; such as the treadmill 200). Accordingly, the arrangement of the bumpers 704 may be adjusted according to the whether the bumpers 704 are implemented in conjunction with a planar treadmill or a non-planar treadmill Regardless of the treadmill with which the bumpers 704 are implemented, the bumpers 704 are structured so as to prevent longitudinally transverse movement of the running belt 706 of the treadmill through contact with an edge of the running belt 706. Accordingly, the running belt 706 is prevented from wearing unevenly or potentially damaging the alignment of the pulleys, belt and frame.

It should be understood that many modifications are possible to the structure and arrangement of the bumpers with the treadmill that are intended to fall within the scope of the present disclosure. For example, the number and placement of the bumpers is highly configurable. In some arrangements, only one bumper per frame side is used. In other embodiments, multiple bumpers per frame side are used. As another example and rather than multiple bumpers per frame side member, one long bumper may be coupled to each frame side member. As yet another example, the bumper may be replaceable. For example, a strip of Velcro may be coupled to the left and right hand side frame members. If the bumper wears down, the old bumper may be discarded and a new bumper may be coupled to the strip of Velcro thereby enabling an easy replacement of the bumper. This arrangement also allows for easy replacement and adjustment of the bumper relative to the left and right hand side frame members (e.g., up/down, left/right, etc.). Further, the use of Velcro in this manner enables an easy retrofitting of the bumper with existing treadmills. As yet another example, the bumpers 704 may also be configured to be dynamically adjustable or rigidly coupled to the frame. For example, the bumpers 704 may be configured to be dynamically adjustable relative to the frame (particularly, the left and right-side members). For example, upon receiving a contact from the running belt 706, the bumpers 704 are configured to move within a specified range of motion outwards and away from the transverse center of the running belt. The bumpers may either deflect (e.g., via a resilient material of the bumper) or be movably coupled to the frame to allow for such movement. The bumpers 704 may also be configured to be rigid such that upon receiving contact from the running belt 706 as a result of a transverse force, the bumpers 704 do not move relative to the frame (particularly, the left and right-side members of the frame).

Additionally, other devices configured to prevent and/or restrict movement of the running belt 706 in a longitudinally transverse direction are also possible. As shown, the bumper 704 has a block-like structure. However, in other embodiments, a roller may be used. One or more rollers (e.g., wheel, bearing, etc.) may be rotatably coupled to the left and right hand side members of the frame. Upon impact of the running belt with the one or more rollers, they may simply rotate which beneficially functions to minimally slow down the movement of the treadmill belt yet still nudge the belt back to its desired position. As a variation of this arrangement, one or more rollers and one or more bumpers 704 may be used. As still another variation, a roller may be included with the bumper such that a surface of the wheel of the bumper 704 is configured to contact a lateral edge of the running belt 706 upon longitudinally transverse movement thereof. Accordingly, as the running belt 706 rotates about the treadmill, the roller of the bumper 704 may rotate such that the running belt is prevented from moving further in the aforementioned longitudinally transverse or misaligned direction.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above.

What is claimed is:

1. A treadmill, comprising;

a frame having a front end and a rear end, substantially opposite the front end;

a front shaft assembly coupled to the frame proximate the front end of the frame;

a rear shaft assembly coupled to the frame proximate the rear end of the frame;

a running belt disposed about the front and rear shaft assemblies; and a bumper coupled to the frame proximate the running belt such that the bumper is disposed between the running belt and the frame, wherein the bumper comprises a partially rounded surface and a substantially flat surface, and wherein in use, the partially rounded surface and the substantially flat surface of the bumper are each configured to selectively directly engage and restrict movement of the running belt towards at least a portion of the frame.

2. The treadmill of claim 1, wherein the running belt defines a running surface, and wherein the bumper is disposed at least partially below the running surface.

3. The treadmill of claim 1, wherein the bumper includes a first bumper and a second bumper, the first bumper disposed between the frame and the running belt and the second bumper disposed between the frame and the running belt such that the first and second bumpers are disposed on opposing transverse sides of the running belt.

4. The treadmill of claim 1, wherein the bumper is at least partially constructed from at least one of Nylon or ultra-high molecular weight Polyethylene.

5. The treadmill of claim 1, wherein in use, each of the partially rounded surface and the substantially flat surface of the bumper are configured to selectively deflect inwardly away from the running belt upon an impact of the running belt with the bumper.

6. The treadmill of claim 1, wherein in use, the bumper is substantially rigid and non-deflecting such that the running belt slides or rubs against the partially rounded surface and the substantially flat surface of the bumper with substantially no inward deflection of the bumper.

7. The treadmill of claim 1, wherein the substantially flat surface of the bumper comprises an aperture that receives a fastener to couple the bumper to the frame.

8. The treadmill of claim 1, wherein the bumper is directly coupled to the frame.

9. The treadmill of claim 1, wherein the partially rounded surface and the substantially flat surface of the bumper are made of at least partially different materials.

10. A treadmill, comprising;

a frame having a front end and a rear end substantially opposite the front end;

a front shaft assembly coupled to the frame proximate the front end of the frame;

a rear shaft assembly coupled to the frame proximate the rear end of the frame;

a running belt disposed about the front and rear shaft assemblies;

a first left side bumper coupled to the frame proximate the running belt such that the first left side bumper is disposed between the frame and the running belt, wherein in use, the first left side bumper is configured to selectively restrict movement of the running belt toward the frame; and a first right side bumper coupled to the frame proximate the running belt such that the first right side bumper is disposed between the frame and the running belt, wherein in use, the first right side bumper is configured to selectively restrict movement of the running belt toward the frame, wherein each of the first left side bumper and the first right side bumper comprise a partially rounded surface and a substantially flat surface, and wherein in use the partially rounded surface and the substantially flat surface of each of the first left side bumper and the first right side bumper are configured to selectively directly engage the running belt.

11. The treadmill of claim 10, wherein the first left side bumper is positioned on or substantially on a transverse opposite side of the running belt relative to the first right side bumper.

12. The treadmill of claim 10, further comprising:

a second left side bumper coupled to the frame and spaced apart from the first left side bumper, wherein in use, the second left side bumper is configured to selectively restrict movement of the running belt toward the frame; and a second right side bumper coupled to the frame and spaced apart from the first right side bumper, wherein in use, the second right side bumper is configured to selectively restrict movement of the running belt toward the frame.

13. The treadmill of claim 12, wherein each of the first and second left side bumpers and the first and second right side bumpers are substantially identical in shape to each other.

14. The treadmill of claim 12, wherein at least one of the first and second left side bumpers and the first and second right side bumpers differs in shape relative to the remaining of the at least one of the first and second left side bumpers and the first and second right side bumpers.

15. The treadmill of claim 10, wherein the running belt defines a running surface at least a portion of which is curved.

16. The treadmill of claim 15, wherein at least a portion of one of the first left and right side bumpers is positioned at or below the running surface.

17. A method of restricting movement of a running belt of a treadmill relative to a frame of the treadmill, the method comprising:

providing a frame including a left side member and a right side member, the left side member spaced apart from the right side member;

providing a running belt coupled to the frame;

disposing a first bumper between the right side member of the frame and the running belt;

disposing a second bumper between the left side member of the frame and the running belt, wherein each of the first bumper and the second bumper comprise a partially rounded surface and a substantially flat surface; and the partially rounded surface and the substantially flat surface of at least one of the first bumper or the second bumper each selectively directly engaging and restricting lateral movement of the running belt relative to the frame.

18. The method of claim 17, wherein the running belt defines a running surface, at least a portion of which is curved.

19. The method of claim 17, wherein during selectively directly engaging and restricting the running belt, the running belt slides along or rubs against the partially rounded surface of one of the first bumper or the second bumper.

20. The method of claim 17, further comprising:

in response to selectively directly engaging and restricting the running belt, deflecting, by the at least one of the partially rounded surface or the substantially flat surface of one of the first bumper or the second bumper inwardly away from the running belt.

* * * * *